US007214164B2

(12) United States Patent
Shomura et al.

(10) Patent No.: US 7,214,164 B2
(45) Date of Patent: May 8, 2007

(54) SHIFT OPERATION CONTROL SYSTEM

(75) Inventors: Nobuyuki Shomura, Hamamatsu (JP); Hidehiko Yoshioka, Hamamatsu (JP); Shuichi Hagino, Hamamatsu (JP); Tomohiko Miyaki, Hamamatsu (JP)

(73) Assignee: Suzuki Motor Corporation, Hamamatsu-shi (JP)

( * ) Notice: Subject to any disclaimer, the term of this patent is extended or adjusted under 35 U.S.C. 154(b) by 201 days.

(21) Appl. No.: 11/022,500

(22) Filed: Dec. 22, 2004

(65) Prior Publication Data

US 2006/0135314 A1 Jun. 22, 2006

(51) Int. Cl.
*B60W 10/04* (2006.01)

(52) U.S. Cl. ..... 477/113; 340/456

(58) Field of Classification Search ..... 477/113, 477/101, 102, 103

See application file for complete search history.

(56) References Cited

U.S. PATENT DOCUMENTS 4,843,914 A * 7/1989 Koike ..... 477/109
4,903,662 A * 2/1990 Hirukawa et al. ..... 477/101
5,050,461 A 9/1991 Onoue et al.
5,827,150 A * 10/1998 Mukumoto ..... 477/101
5,853,306 A * 12/1998 Worth et al. ..... 440/1
6,942,530 B1 * 9/2005 Hall et al. ..... 440/1
2004/0147364 A1 * 7/2004 Wakashiro et al. ..... 477/3

FOREIGN PATENT DOCUMENTS

JP 63-137098 A 6/1988
JP 63-195094 A 8/1988
JP 01-182196 A 7/1989
JP 02-216391 A 8/1990
JP 2001-152897 A 6/2001

* cited by examiner

*Primary Examiner*—Roger Pang
*Assistant Examiner*—Edwin A. Young
(74) *Attorney, Agent, or Firm*—Frishauf, Holtz, Goodman & Chick, P.C.

(57) ABSTRACT

A shift operation control system for an outboard motor, which is capable of reducing a load acting on a shift operation lever during a shift operation and a shock occurring during the shift operation, to thereby facilitate the shift operation. The shift operation by the shift operation lever (21) is continuously detected by a shift position detector (24), and when an early stage of the shift operation from the forward position to the neutral position or from the reverse position to the neutral position is detected and at the same time the engine speed at the detection is not less than a predetermined value, engine output reduction control is carried out, and when the shift position detector (24) detects that the shift position has been switched to the neutral position, the engine output reduction control is canceled.

16 Claims, 23 Drawing Sheets

SHIFT OPERATION CONTROL SYSTEM

BACKGROUND OF THE INVENTION

1. Field of the Invention

The present invention relates to a shift operation control system for outboard motors including a forward/reverse-switching mechanism that switches between a forward position, a neutral position, and a reverse position in response to the operation of a shift operation lever.

2. Description of the Related Art

Conventionally, the outboard motors are equipped with a forward/reverse-switching mechanism disposed between a drive shaft connected (or gear-connected) to the crankshaft of an engine and a propeller shaft as the rotating shaft of a propeller, for switching between the forward position, the neutral position, and the reverse position.

The forward/reverse-switching mechanism is comprised of a drive gear fixed to the lower end of the drive shaft, a forward gear and a reverse gear rotatably disposed on the propeller shaft, which are meshed with the drive gear, and a dog clutch disposed between the forward gear and the reverse gear, for being shifted to one of the neutral position, the forward position, and the reverse position, whereby the shift position is switched between the neutral position, the forward position, and the reverse position.

In this type of forward/reverse-switching mechanism, when a shift operation is carried out from a state in which one of the forward gear and the reverse gear is meshed with the dog clutch, the dog clutch is sometimes difficult to pull off and remains meshed with the gear. To overcome this problem, there has been proposed a system for facilitating the shift operation, in which load applied to the shift operation lever (a force for operating the shift operation lever or a pulling force) during the shift operation is detected, and when the detected load is not lower than a predetermined load (load setting value), the output from the associated engine (engine output) is reduced by turning ignition off (misfiring control) or the like (see e.g. Japanese Laid-Open Patent Publications (Kokai) No. S63-137098, S63-195094, H01-182196, and H02-216391).

Further, when the shift operation is carried out on the onboard motor to switch from the neutral position to the forward position or the reverse position, the dog clutch instantaneously connects between a rotating part of the engine and a gear part of the propeller, which generates a substantial shock (impact) when the gear part of the propeller is in stoppage. Further, immediately after the shift operation, a hull in which the outboard motor is installed receives shocks (vibrations) generated due to the propeller thrust. To eliminate these inconveniences, there has been proposed a method in which when the engine is idling and the shift operation lever is detected to have left the neutral position, the engine speed is controlled to be reduced, and when a shift operation is detected, the control for reducing the engine speed is cancelled (see e.g. Japanese Laid-Open Patent Publication (Kokai) No. 2001-152897).

However, in the case of a conventional control method used in the system described above, in which the load acting on the shift operation lever during operation thereof is detected, and when the detected load is not lower than the predetermined load, the engine output is reduced, it is difficult to accurately detect the load acting on the shift operation lever due to the influence of the magnitude and stability (torque variation) of drive torque of the engine of the outboard motor, and practically difficult to set the load setting value.

Further, according to this conventional control method, the engine output (drive torque) is not reduced until after the load on the shift operation lever (i.e. the magnitude of a force for operating the shift operation lever) has reached the predetermined value during the shift operation, and therefore the force required for the shift operation becomes larger than the predetermined value before the drive torque is actually reduced, which makes it impossible to easily operate the shift operation lever.

On the other hand, to reduce the shock (shift shock) occurring during the shift operation, it is essential to quickly detect the shift operation. If a switch for detecting the shift operation is configured to detect the shift lever leaving from the neutral position in earlier timing, a shift operation not according to the operator's intention to carry out the shift operation lever is detected, and therefore an erroneous detection tends to occur. Conversely, if the switch is configured to detect the shift lever leaving from the neutral position in later timing, the detection of the shift operation becomes too late to reduce the shift shock sufficiently.

Further, in the conventional method of lowering the engine speed upon detection of the shift operation, a state of operation or position of the shift operation lever after the shift operation is carried out cannot be detected, and therefore, if the shift operation lever is stopped at a position which is neither the neutral position nor the forward or reverse position, the engine speed reduction control continues to be carried out.

SUMMARY OF THE INVENTION

It is an object of the present invention to provide a shift operation control system for outboard motors, which is capable of reducing load acting on a shift operation lever during a shift operation and a shock occurring during the shift operation, to thereby facilitate the shift operation.

To attain the above object, the present invention provides a shift operation control system for an outboard motor including an engine, and a forward/reverse-switching mechanism having a forward gear, a reverse gear, a dog clutch, and a shift operation lever, wherein an output from the engine is selectively transmitted to the forward gear or the reverse gear, for driving the forward gear or the reverse gear, and the dog clutch is actuated by a shift operation using the shift operation lever to switch a shift position between a forward position in which the dog clutch is meshed with the forward gear, a reverse position in which the dog clutch is meshed with the reverse gear, and a neutral position in which the dog clutch is not meshed with either the forward gear or the reverse gear, comprising a shift operation-detecting device that continuously detects the shift operation by the shift operation lever, an engine output changing control device that changes the output from the engine, and a control device that is operable when an early stage of the shift operation is detected by the shift operation-detecting device, to carry out control for changing the output from the engine using the engine output changing control device to change the output from the engine and then cancel the control for changing the output from the engine.

With the arrangement of the shift operation control system according to the present invention, the early stage of the shift operation, i.e. a state just before the operating force applied by the operator to the shift operation lever is increased is detected, and the engine output is reduced when it is predicted that the operating force applied to the shift operation lever will be increased, whereby the load acting on the shift operation lever or a shock occurring during the shift operation is reduced, which facilitates the shift operation.

Preferably, the control device carries out the control for changing the output from the engine using the engine output changing control device when an early stage of the shift operation from the forward position to the neutral position or from the reverse position to the neutral position is detected by the shift operation-detecting device, and a speed of the engine upon the detection of the early stage is not lower than a predetermined engine speed value, and cancels the control for changing the output from the engine when switching of the shift position to the neutral position is detected by the shift operation-detecting device.

With this arrangement, the early stage of the shift operation from the forward position to the neutral position or from the reverse position to the neutral position is detected, and when the engine speed detected upon the detection of the early stage is not lower than a predetermined engine speed value, i.e. when it is predicted that the operating force applied to the shift operation lever will increase, the engine output is reduced, whereby the shift operation can be carried out with a force smaller than that required in the prior art, which makes it easy to perform the shift operation.

More preferably, the control device carries out the control for changing the output from the engine when the early stage of the shift operation is detected by the shift operation-detecting device, and a throttle opening of the engine is not larger than a predetermined opening value.

With this arrangement, if, upon detection of the early stage of the shift operation by the shift operation detecting device, the throttle opening is not smaller than a predetermined value, control is performed to change the engine output. As a result, it is possible to prevent an erroneous detection of the shift operation when an external force other than that for the shift operation acts on the shift operation lever e.g. when a rapid acceleration is carried out, a jump occurs during running of the boat, or on other occasions.

More preferably, the control device carries out the control for changing the output from the engine when the early stage of the shift operation is detected by the shift operation-detecting device, and intake negative pressure in the engine is not higher than a predetermined negative pressure value.

With this arrangement, if, upon detection of the early stage of the shift operation by the shift operation detecting device, the intake negative pressure is not higher than a predetermined value, control is performed to change the engine output, which makes it possible to avoid an increase in the force for operating the shift operation lever (shifting force) occurring when the follow-up of the engine speed is delayed with respect to a sudden opening or closing of a throttle at throttle snap.

More preferably, the control device determines that the shift operation is in the early stage when it is detected by the shift operation-detecting device that a shift position of the shift operation lever is in a vicinity of the forward position or the reverse position, and an amount of change in the detected shift position is not smaller than a predetermined change amount value.

With this arrangement, when the shift operation detecting device detects that the shift position is in the vicinity of the forward position or the reverse position, and at the same time, the amount of change in the detected shift position is not less than a predetermined value, the control device determines that the shift operation is in the early stage, so that it is possible to accurately and promptly determine whether or not the shift operation is being carried out, by preventing erroneous detection or delayed detection of the shift operation due to assemblage errors of the shift operation detecting device and variations in the output thereof.

More preferably, the engine output changing control device changes the output from the engine by carrying out ignition control based on a number of consecutive misfires or an ignition timing retardation value, the number of consecutive misfires or the ignition timing retardation value being set in advance on an engine speed region-by-engine speed region basis.

With this arrangement, the engine output changing control device changes the engine output by carrying out firing control based on the number of consecutive misfires or the ignition timing retardation value set on an engine speed region-by-engine speed region basis. As a result, the engine output can be reduced while preventing engine stalling under various conditions.

More preferably, the engine output changing control device sets an allowable slope of reduction in the speed of the engine per each predetermined number of times of ignition, and changes the number of consecutive misfires or the ignition timing retardation value when a slope of reduction in the speed of the engine exceeds the allowable slope set in advance.

With this arrangement, the engine output changing control device sets the allowable slope of reduction in the engine speed with respect to each predetermined number of times of ignition, and when the set allowable slope of reduction exceeds a predetermined value, the number of consecutive misfires or the ignition timing retardation value is changed. This makes it possible to ensure the advantageous effects of preventing engine stalling.

More preferably, the control device sets a lower limit of an allowable slope of reduction in the speed of the engine per each predetermined number of times of ignition, and cancels the control for changing the output from the engine when the speed of the engine exceeds the lower limit of the allowable slope of reduction in the speed of the engine.

With this arrangement, the engine output changing control device sets the lower limit of the allowable slope of reduction in the engine speed per each predetermined number of times of ignition, and when the slope of reduction in the engine speed exceeds the set lower limit value, the control for changing the engine output is canceled. This makes it possible to prevent engine stalling during changing of the engine output.

Preferably, the control device carries out the control for changing the output from the engine using the engine output changing control device when an early stage of the shift operation from the neutral position to the forward position or from the neutral position to the reverse position is detected by the shift operation-detecting device, and cancels the control for changing the output from the engine after a predetermined time period elapses after completion of the control for changing the output from the engine.

With this arrangement, when the shift operation detecting device detects the early stage of the shift operation from the neutral position to the forward position or from the neutral position to the reverse position is detected, control is performed to change the engine output, and after the lapse of the predetermined time period, the control for changing the engine output is canceled. This makes it possible to reduce a shock at the time of shift operation and hence carry out the shift operation with ease.

More preferably, the control device determines that the shift operation is in the early stage when it is detected by the shift operation-detecting device that a shift position of the shift operation lever is in a vicinity of the neutral position, and an amount of change in the detected shift position exceeds a predetermined change amount value set for the neutral position.

With this arrangement, when the shift position detected by the shift operation detecting device is in the vicinity of the neutral position, and at the same time the amount of change in the detected shift position is not smaller than the predetermined value and exceeds the predetermined value set for the neutral position, the control device determines that the shift operation is in its early stage. As a result, it is possible to promptly and accurately determine whether a shift operation is being carried out the shift operation by preventing erroneous detection or delayed detection of the shift operation due to assemblage errors in the shift operation detecting device or variations in the output from the shift operation detecting device.

Preferably, the shift operation-detecting device includes a learning device that detects a change in an output value from the shift operation-detecting device, the output value being produced when the shift position is the neutral position, the learning device being operable when the output value is changed, to learn the changed output value.

With this arrangement, when the shift operation detecting device detects a change in the engine output value at the neutral position, the engine output value after the change is learned by the learning device. As a result, even if the engine output value at the neutral position is changed due to aging or the like, it is possible to promptly and accurately detect the shift operation.

More preferably, the shift operation-detecting device includes a determining device that determines a shift operation speed from an amount of change in the detected shift position, and the control device carries out the control for changing the output from the engine when it is determined by the determining device that the shift operation speed is not higher than a predetermined value.

With this arrangement, the determining device of the shift operation detecting device determines the shift operation speed from the amount of change in the detected shift position, and the control device changes the engine output when the shift operation speed is not lower than the predetermined value (predetermined output change amount). This makes it possible to prevent a stubble or unstable engine rotation by limiting the engine output change control at rapid acceleration.

More preferably, the control device includes a determining device that determines a speed of a boat in which the outboard motor is installed, based on the speed of the engine detected when the shift operation from the forward position to the neutral position is detected, and a duration over which the neutral position has been maintained, and the control device carries out the control for changing the output from the engine when it is determined by the determining device that the speed of the boat is not higher than a predetermined value.

With this arrangement, the control device determines the running speed of the boat from the engine speed during the shift operation from the forward position to the neutral position and the duration over which the neutral position has been maintained, and if the running speed of the boat is not higher than the predetermined value, the engine output is changed. This makes it possible to reduce a shock occurring during the shift operation and facilitate the shift operation.

More preferably, the engine output changing control device includes an intake air amount control device that controls an amount of intake air supplied to the engine, and the engine output changing control device changes the output from the engine by misfiring control or ignition timing control, while causing the intake air amount control device to increase the amount of intake air.

With this arrangement, the intake air amount control device of the engine output changing control device controls the amount of intake air supplied to the engine, and the engine output is changed through misfiring or ignition timing retardation, and through increase of the intake air amount by the intake air amount control device. As a result, it is possible to promptly reduce the engine output while preventing engine stalling even under various conditions.

More preferably, the control device immediately cancels the control for changing the output from the engine when predetermined conditions for canceling the control for changing the output from the engine are satisfied before the predetermined time period elapses.

With this arrangement, when the predetermined conditions for canceling the engine output change control are satisfied before the lapse of the predetermined time period, the control device immediately cancels the control for changing the engine output. As a result, it is possible to promptly reduce the engine output while preventing engine stalling even under various conditions.

Preferably, the forward/reverse-switching mechanism has a first-actuated driving part inside the outboard motor, and the shift operation-detecting device is disposed at the first-actuated driving part.

With this arrangement, the shift operation detecting device is disposed at the first-actuated driving part of the forward/reverse switching mechanism inside the outboard motor. As a result, it is possible to accurately detect the shift operation by the operator without being influenced by a play or hysteresis of the forward/reverse-switching mechanism.

Preferably, the outboard motor has a remote control box for remotely operating the forward/reverse-switching mechanism inside the outboard motor, and the shift operation lever has a drive part disposed in the remote control box, and the shift operation-detecting device is disposed in the drive part of the shift operation lever.

With this arrangement, the shift operation detecting device is disposed close to the driving part of the shift operation lever disposed in the remote control box for remotely controlling the forward/reverse-switching mechanism of the outboard motor. This makes it possible to detect the shift operation by the operator in earlier timing with higher accuracy without being influenced by a play or hysteresis of lots of linkages disposed between the remote control box and the outboard motor.

The above and other objects, features, and advantages of the present invention will become more apparent from the following detailed description taken in conjunction with the accompanying drawings.

BRIEF DESCRIPTION OF THE DRAWINGS

FIGS. 6A to 6C are diagrams showing output waveforms from the shift position detector, in which FIG. 6A shows the case where load acting on a shift operation lever is low;

FIG. 6B shows the case where the load acting on the shift operation lever is medium; and FIG. 6C shows the case where the load acting on the shift position lever is high;

FIGS. 11A and 11B4 are timing diagrams useful in explaining a method of controlling ignition during the engine output reduction control process, in which:

FIG. 11A shows changes in the number of consecutive misfires made according to the reduction of the engine speed; and FIG. 11B shows changes in the number of consecutive misfires made according to a slope of reduction in the engine speed;

FIGS. 12A and 12B are diagrams useful in explaining timing of the engine output reduction control (execution timing thereof), in which:

FIG. 12A is a diagram showing an example of timing in which the engine output reduction control is carried out when a shift operation is detected; and FIG. 12B is a diagram showing an example of the output from the shift position detector when an erroneous operation is carried out;

FIGS. 14A to 14C are schematic diagrams showing another example of the disposition of the shift position detector, in which:

FIG. 14A is a top view of the shift position detector and its vicinity;

FIG. 14B is a view showing a part of FIG. 14A in transverse cross-section; and FIG. 14C is a view showing another part of FIG. 14A in transverse cross-section;

FIGS. 15A and 15B are fragmentary enlarged views of the shift position detector in FIGS. 14A to 14C, in which:

FIG. 15A is a fragmentary cross-sectional view taken on line B—B of FIG. 14A; and FIG. 15B is an enlarged view of a detection lever and its vicinity in FIG. 14B;

DETAILED DESCRIPTION OF THE PREFERRED EMBODIMENT

The present invention will now be described in detail below with reference to the drawings showing preferred embodiments thereof.

Figure 1:
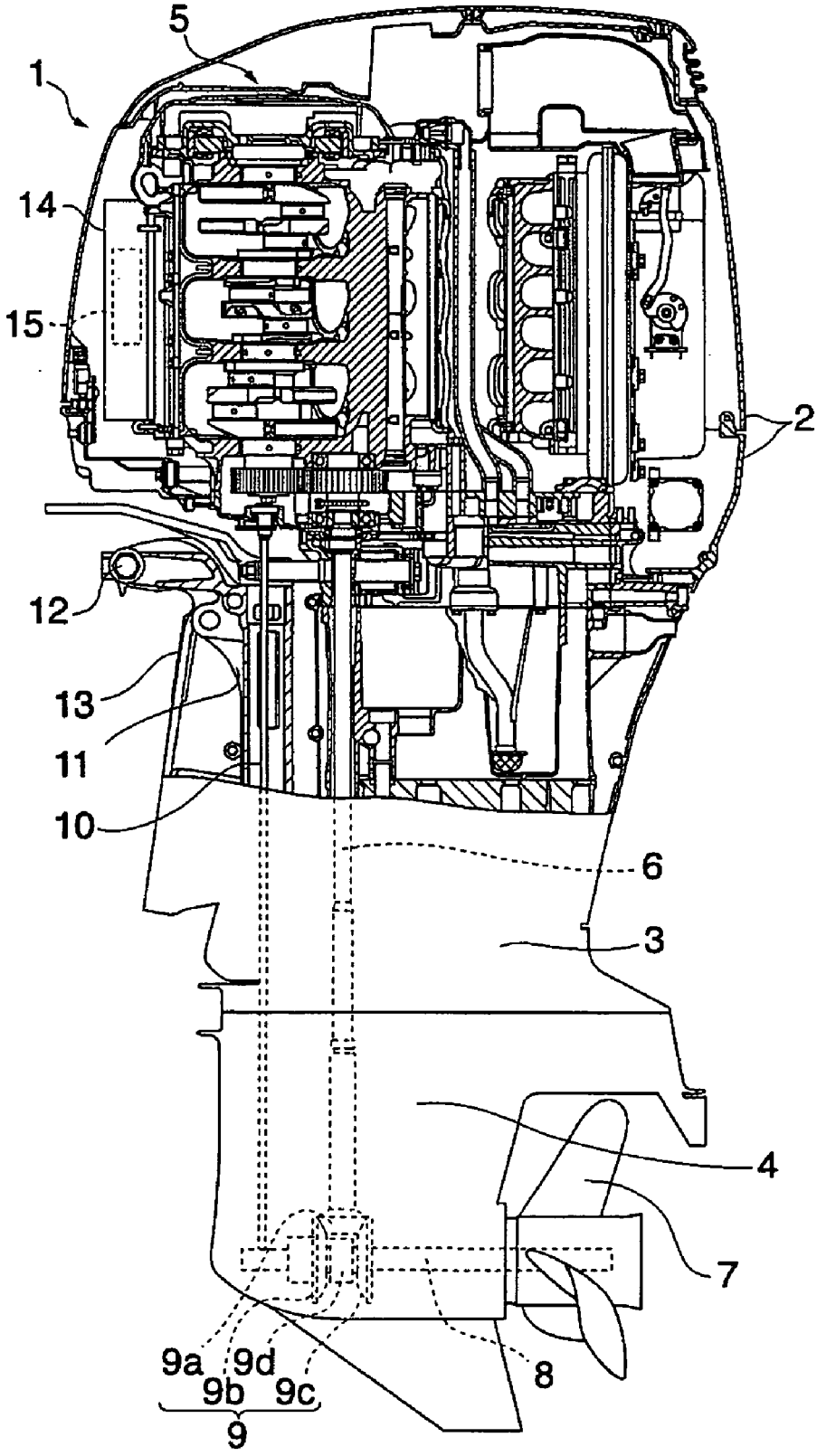
FIG. 1 is a view, partly in longitudinal cross-section, showing the construction of an outboard motor to which is applied a shift operation control system according to a first embodiment of the present invention.

FIG. 1 is a fragmentary longitudinal cross-sectional view showing the construction of an outboard motor to which is applied a shift operation control system according to a first embodiment of the present invention.

As shown in FIG. 1, the outboard motor 1 includes an engine cover 2 which can be divided into an upper half and a lower half, a drive shaft housing 3, and a gear housing 4. Disposed under the engine cover 2 is an engine 5, which is a water-cooled four-cycle six-cylinder V-type engine having a crankshaft, not shown, substantially perpendicularly (vertically) extending therein.

A drive shaft 6 connected (or gear-connected) to the crankshaft of the engine 5 extends from the lower end of the engine 5 through the drive shaft housing 3 into the gear housing 4 within which is disposed a forward/reverse switching mechanism 9.

The forward/reverse switching mechanism 9 is comprised of a drive gear 9*a* implemented by a bevel gear fixed to the lower end of the drive shaft 6, a forward gear 9*b* and a reverse gear 9*c* implemented by respective bevel gears rotatably disposed on a propeller shaft 8, which are meshed with the drive gear 9*a*, and a dog clutch 9*d* disposed between the forward gear 9*b* and the reverse gear 9*c*, for being shifted to one of the neutral position, the forward position, and the reverse position, whereby the shift position is switched between the neutral position, the forward position, and the reverse position.

A shift rod 10 extending parallel with the drive shaft 6 through the drive shaft housing 3 is pivotally movable to move the dog clutch 9*d* into mesh with either the forward gear 9*b* or the reverse gear 9*c*, or place the same in an intermediate position therebetween in which it is not meshed with either of them, whereby the transfer of torque from the drive shaft 6 to the propeller shaft 8 is permitted or inhibited.

The outboard motor 1 is horizontally pivotally supported by a swivel bracket 11, with an upper part of the swivel bracket 11 being supported on a clamp bracket 13 for vertically pivotal movement via a tilt shaft 12. When the clamp bracket 13 is removably fixed to a stern frame of a hull, not shown, the outboard motor 1 is mounted on the hull such that it can be pivoted horizontally (in a steering direction) and vertically (in a tilting direction).

Further, in front of the engine 5, there is disposed an electrical equipment box 14 containing electrical control components including an ECM (Engine Control Module) 15.

Figure 2:
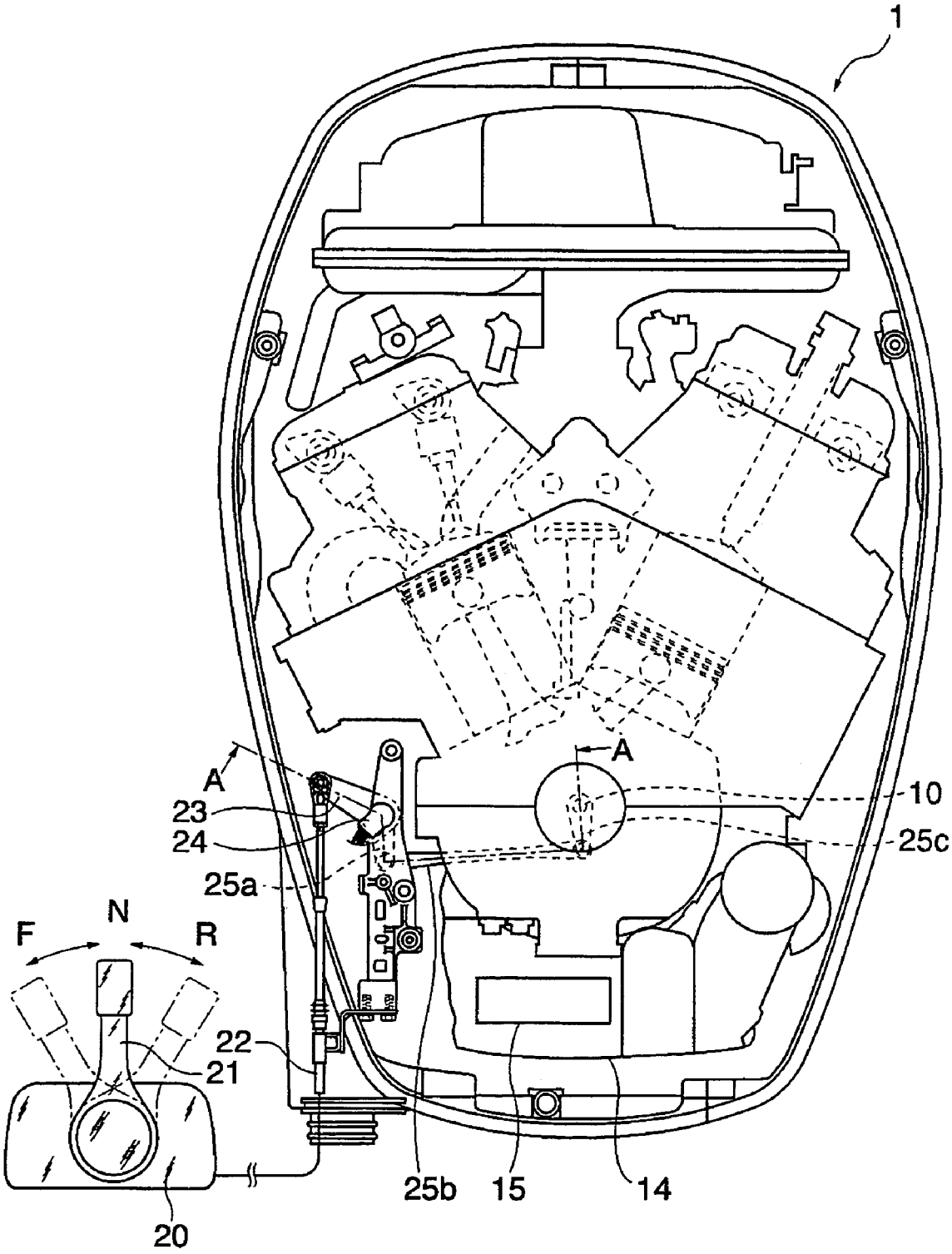
FIG. 2 is a cross-sectional view of component parts inside an engine cover of the outboard motor in FIG. 1.

FIG. 2 is a transverse cross-sectional view of component parts inside the engine cover 2 of the outboard motor 1 in FIG. 1.

In FIG. 2, a remote control box 20 is disposed within the hull, and includes a shift operation lever 21 for carrying out a shift operation (switching operation) to switch between three positions forward position, neutral position, and reverse position. The shift operation lever 21 is connected to a shift lever 23 inside the outboard motor 1 via a remote control cable 22 comprised of inner and outer cables. The shift lever 23 is connected to a shift rod 10 via a plurality of shift operation links 25*a*, 25*b*, and 25*c*. A shift position detector 24 is disposed at an upper end of a pivot 23*a* of the shift lever 23.

Figure 3:
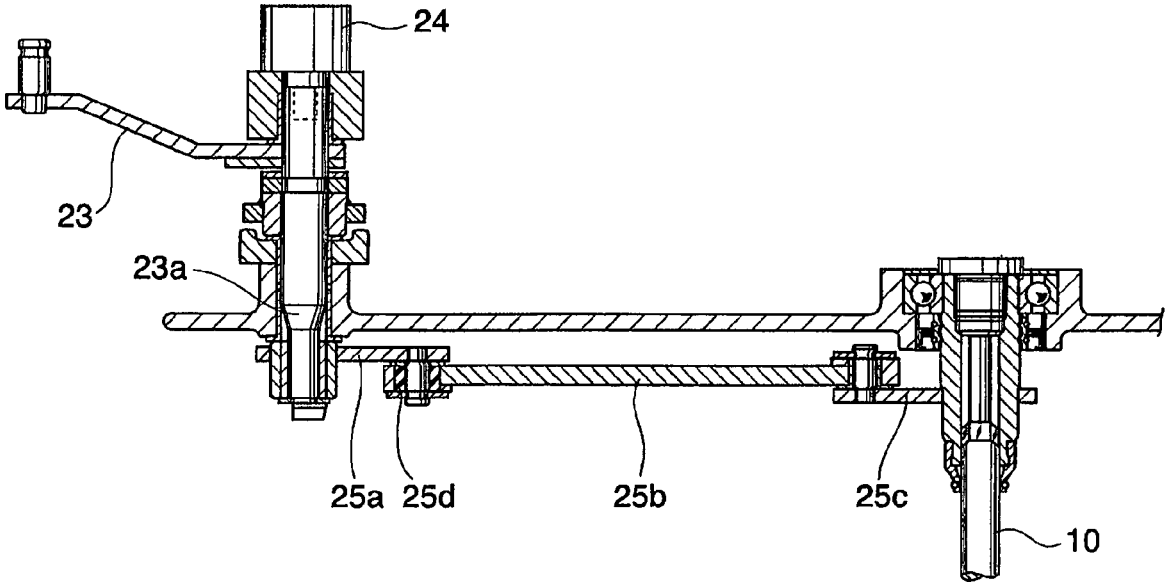
FIG. 3 is a fragmentary enlarged view taken on line A—A in FIG. 2.

FIG. 3 is a fragmentary cross-sectional view showing the arrangement of a sequence of components from the shift lever 23 to the shift rod 10.

In FIG. 3, when the operator operates the shift operation lever 21, the shift lever 23 connected thereto via the remote control cable 22 is pivotally moved about its pivot 23*a*, and the pivotal movement of the shift lever 23 in turn drives the shift operation links 25*a*, 25*b*, and 25*c* connected to the shift lever 23 via the pivot 23*a* to thereby pivotally move the shift rod 10. This causes movement of the dog clutch 9*d* of the forward/reverse-switching mechanism 9 to perform switching (shifting) between the three positions: forward position, neutral position, and reverse position.

A damper 25*d* implemented by a resilient member formed e.g. of rubber is interposed between connecting ends of the shift operation links 25*a* and 25*b*. The damper 25 may be interposed between the shift operation links 25*b* and 25*c*.

For example, when a shift operation from the forward (F) position to the neutral (N) position, or a shift operation in an opposite direction is performed, the gears are sometimes not instantly disengaged so that the movement of the shift rod 10 is stopped for a moment. In this case, due to the stoppage, the output value from the shift position detector 24 instantly stops changing to exhibit a flat waveform, which can cause a delay in the start of engine output change control. Further, the momentary stoppage of the shift rod makes the operator feel a sense of disorder or feel the shift operation lever 21 heavy to operate. To permit smooth pivotal movement of the shift lever 23 without being stopped, the above-mentioned damper 25*d* is provided.

Figure 4:
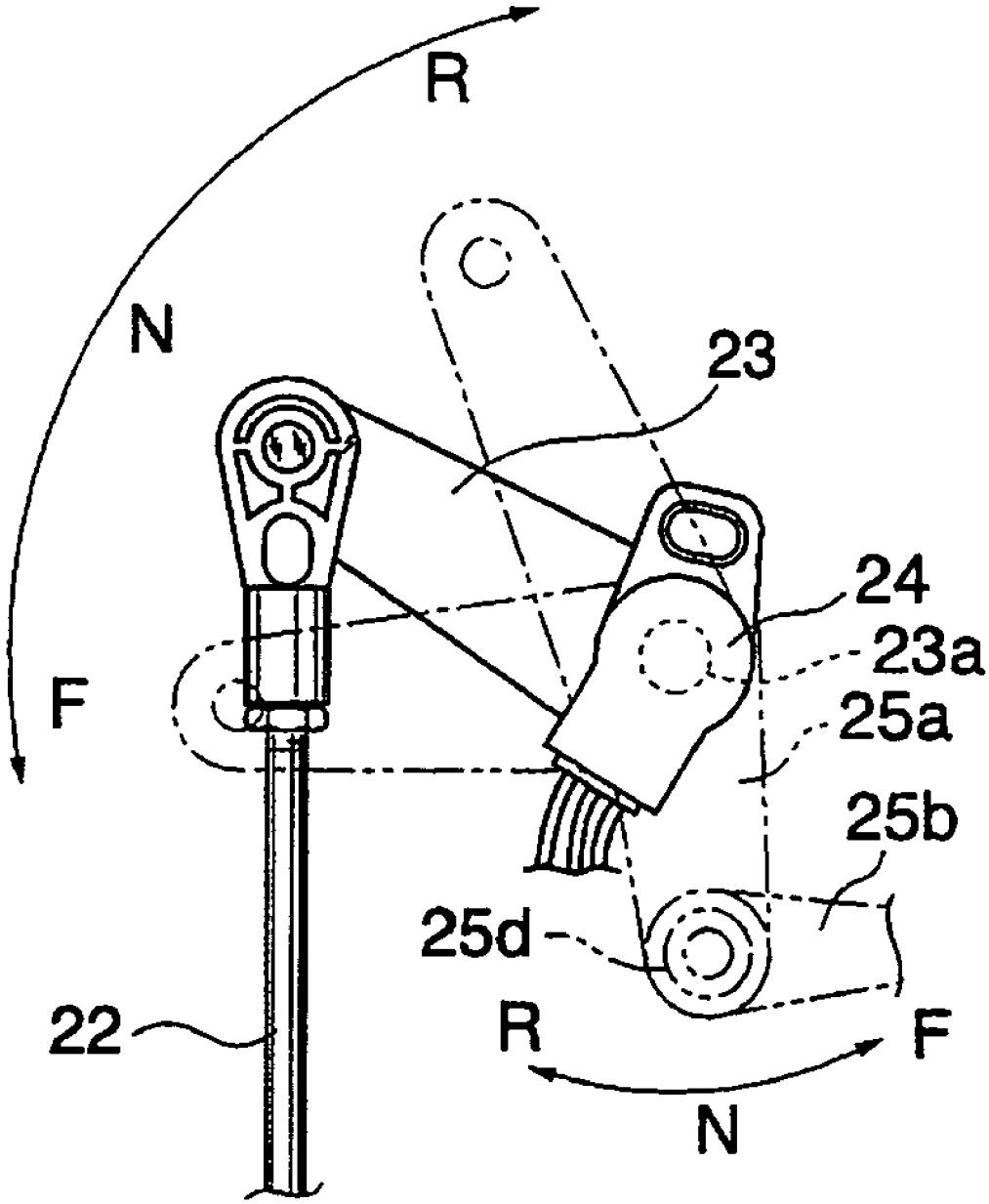
FIG. 4 is an enlarged view showing a shift position detector and its vicinity in FIG. 2.

FIG. 4 is an enlarged view showing the shift position detector 24 and its vicinity in FIG. 2.

Figure 5:
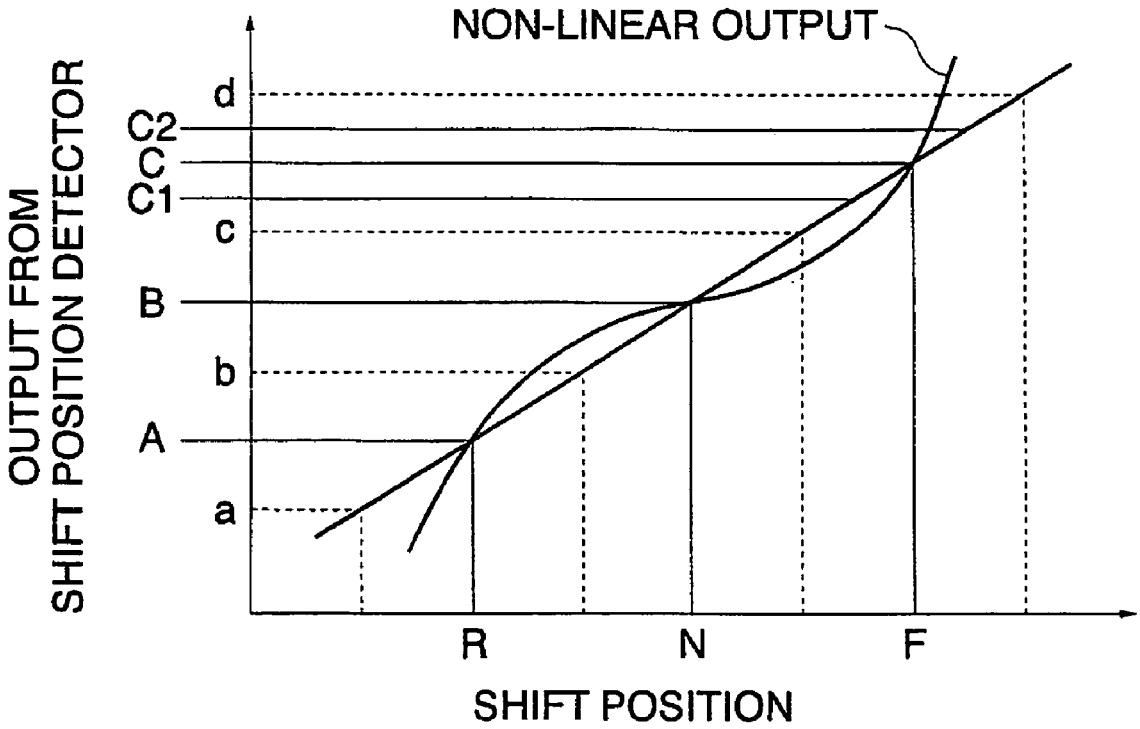
FIG. 5 is a diagram showing the relationship between an output from the shift position detector and the shift position.

As shown in FIG. 4, the shift position detector 24, which is connected to the ECM 15 via a signal line, not shown, is disposed on the pivot 23*a* of the shift lever 23. The shift position detector 24 is implemented by a rotary variable resistor which generates an output (voltage) corresponding to the rotational position of the shift lever 23, as shown in FIG. 5, based on which the shift position is continuously detected, thereby detecting whether or not a shift operation is performed, shift operation timing, and a shift position.

The shift position detector 24 is disposed at a first-actuated rotary part (drive part) of a shift mechanism including the shift lever 23, the shift operation links 25*a*, 25*b*, and 25*c*, and the forward/reverse-switching mechanism 9 inside the outboard motor 1, and therefore it is suited or correctly detecting the shift operation of the operator in early timing. In addition, the pivot of the rotary variable resistor of the shift position detector 24 is directly connected to the upper end of the pivot 23*a* of the shift lever 23, which enables designing of the shift mechanism compact in size using a small number of component parts and facilitates the assemblage, and further, the pivot of the rotary variable resistor is directed downward, which improves the waterproof reliability of the shift mechanism. Further, by coupling the pivot 23*a* to the pivot of the rotary variable resistor via a resin member or the like, it is possible to reduce vibrations that the shift position detector 24 receives from the pivot 23*a* of the shift lever 23.

Figure 6A:
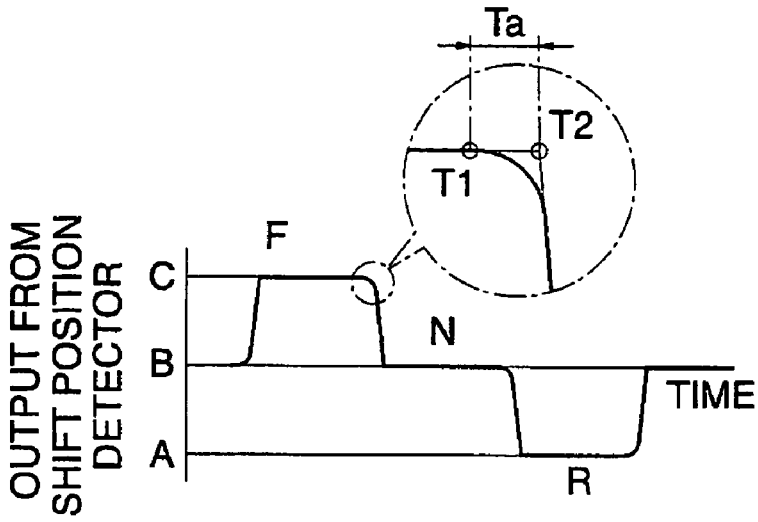
Figure 6B:
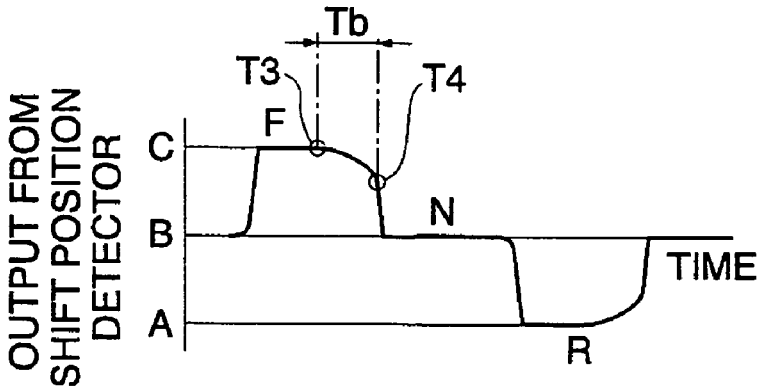
Figure 6C:
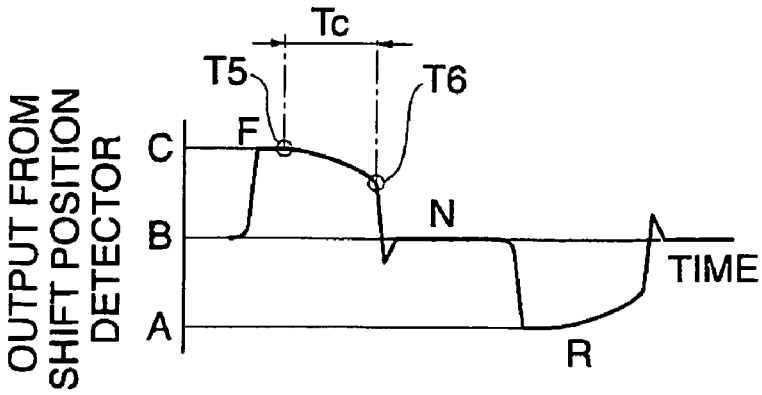

FIGS. 6A to 6C are diagrams showing output waveforms from the shift position detector 24, in which FIG. 6A shows the case where load acting on the shift operation lever 21 is low, FIG. 6B shows the case where the load is medium, and FIG. 6C shows the case where the load is high.

As shown in FIGS. 6A to 6C, when the shift operation lever 21 is operated for a shift from the F position to the N position, the output from the shift position detector 24 is changed from a voltage C to a voltage B, and when the shift operation lever 21 is operated for a shift from the R position to the N position, the output from the shift position detector 24 is changed from a voltage A to the voltage B.

When the shift operation is performed from the F position to the N position at a low engine speed, as shown in FIG. 6A, there occurs a slight delay Ta between timing (time point) T1 in which the shift position detector 24 detects a shift operation and timing (time point) T2 in which the dog clutch 9*d* is disengaged from the forward gear 9*b* to set the neutral position. However, load (operating force) applied to the shift operation lever 21 is small.

When the shift operation is performed from the F position to the N position at a medium engine speed, as shown in FIG. 6B, there occurs a delay Tb between timing (time point) T3 in which the shift position detector 24 detects a shift operation and timing (time point) T4 in which the dog clutch 9*d* is disengaged from the forward gear 9*b* to set the neutral position. The delay Tb and the delay Ta are in the relationship of Tb>Ta. In other words, the timing in which the dog clutch 9*d* is disengaged from the forward gear 9*b* to set the neutral position after detection of the shift operation is more delayed than in the case of the FIG. 6A, and an increased force is applied to the shift operation lever 21 for operation thereof.

When the shift operation is performed from the F position to the N position at a high engine speed, as shown in FIG. 6C, there occurs a delay Tc between timing (time point) T5 in which the shift position detector 24 detects a shift operation and timing (time point) T6 in which the dog clutch 9*d* is disengaged from the forward gear 9*b* to set the neutral position. The delay Tc and the delay Tb are in the relationship of Tc>Tb. In other words, the timing in which the dog clutch 9*d* is disengaged from the forward gear 9*b* to set the neutral position after detection of the shift operation is much more delayed.

As described above, in spite of the shift position detector 24 detecting a substantial displacement (movement or rotation) of the shift operation lever 21, the state continues in which the dog clutch 9*d* is not disengaged from the forward gear 9*b*, and the operator increases the operating force applied to the shift operation lever 21, so that the operating force is accumulated in the play of component parts in a force transmission path from the remote control box 20 to the dog clutch 9*d*, such as the shift cable 22 (as expansion and deformation thereof). The instant the dog clutch 9*d* is disengaged from the forward gear 9*b*, the force accumulated moves the shift operation lever 21 beyond the neutral position, and thereafter, the operator, who felt the detent force and noticed the fact that the shift operation lever has been moved beyond the neutral position, operates the shift operation lever 21 back to the neutral position. In this state, the operator not only has to exert a very large force to move the shift operation lever 21, but also perform an additional operation to bring the shift operation lever 21 from a position beyond the neutral position back to the neutral position.

The present invention eliminates the above-described inconvenience as follows: The drive torque (engine output) is not reduced after detecting that the operating force applied to the shift operation lever during a shift position reaches a predetermined value, but an engine output reduction (change) control process is carried out in which an early stage of the shift operation before the operator increases the operating force applied to the shift operation lever 21 is detected, and from the engine speed detected upon detection of the early stage of the shift operation, the engine output is reduced based on a prediction of the magnitude of the operating force to be applied to the shift operation lever 21. This makes it possible to perform a shift operation with a much smaller force than in the prior art.

Figure 7:
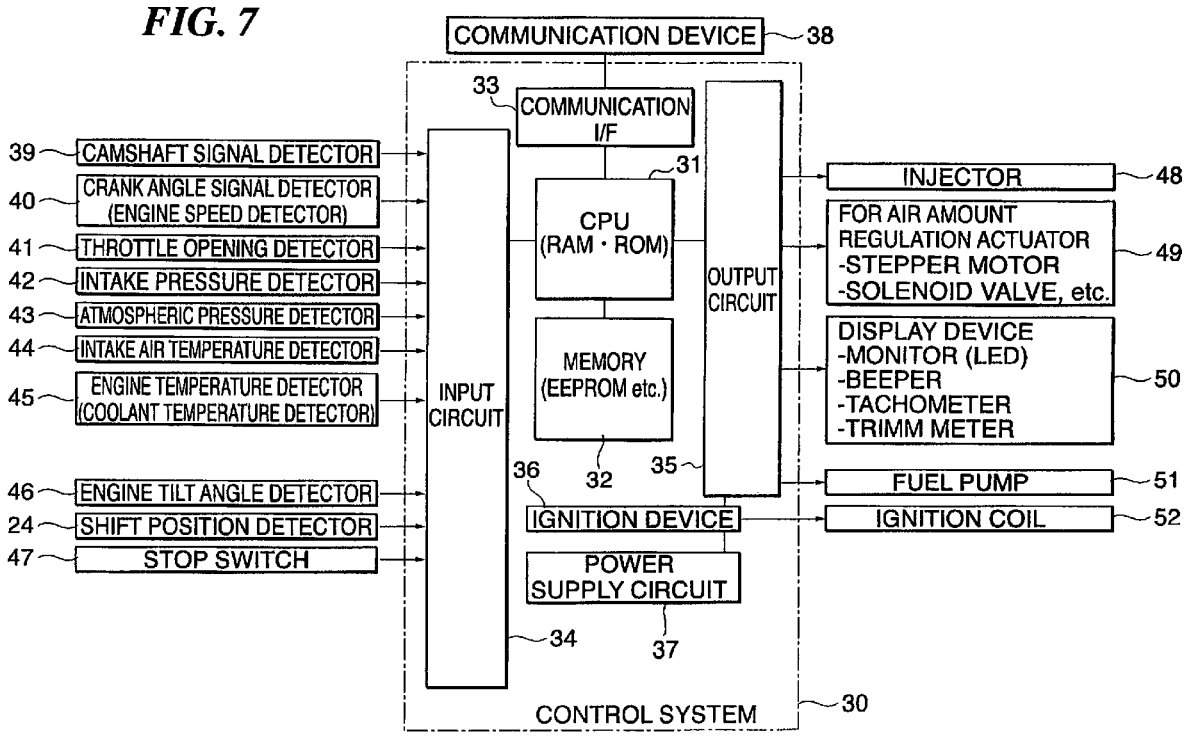
FIG. 7 is a schematic block diagram showing the arrangement of a control system of the outboard motor in FIG. 1.

FIG. 7 is a schematic block diagram of a control system 30 of the outboard motor 1.

As shown in FIG. 7, the control system 30 is comprised of a central processing unit (CPU) 31 including a RAM and a ROM, an EERPOM (Electrically Erasable and Programmable ROM) 32, a communication interface (I/F) 33 connected to an external communication device 38, an input circuit 34, an output circuit 35, an ignition device 36 connected to an external ignition coil, and a power supply circuit 37.

Connected to the input circuit 34 are an external camshaft signal detector 39, a crank angle signal detector (engine speed detector) 40, a throttle opening detector.41, an intake pressure detector 42, an atmospheric pressure detector 43, an intake air temperature detector 44, an engine temperature detector (coolant temperature detector) 45, an engine tilt angle detector 46, the shift position detector 24, and a stop switch 47.

Connected to the output circuit 35 are an external fuel injector 48, an air amount regulator/actuator 49 comprised of a stepper motor and a solenoid valve, a display device 50 comprised of an LED, a beeper, a tachometer, and a trim meter, and a fuel pump 51.

The CPU 31 of the control system 30 calculates the intake air amount based on detection signals from associated ones of the above-mentioned detectors, calculates an optimum fuel injection amount based on a value of the intake air amount obtained by subjecting the detected intake air amount to various corrections, and delivers a drive signal indicative of a duty ratio corresponding to the calculated fuel injection amount to the injector 48 via the output circuit 35. This makes it possible to cause the injector 48 to inject the optimum amount of fuel suited to the calculated intake air amount by duty ratio control.

Figure 8:
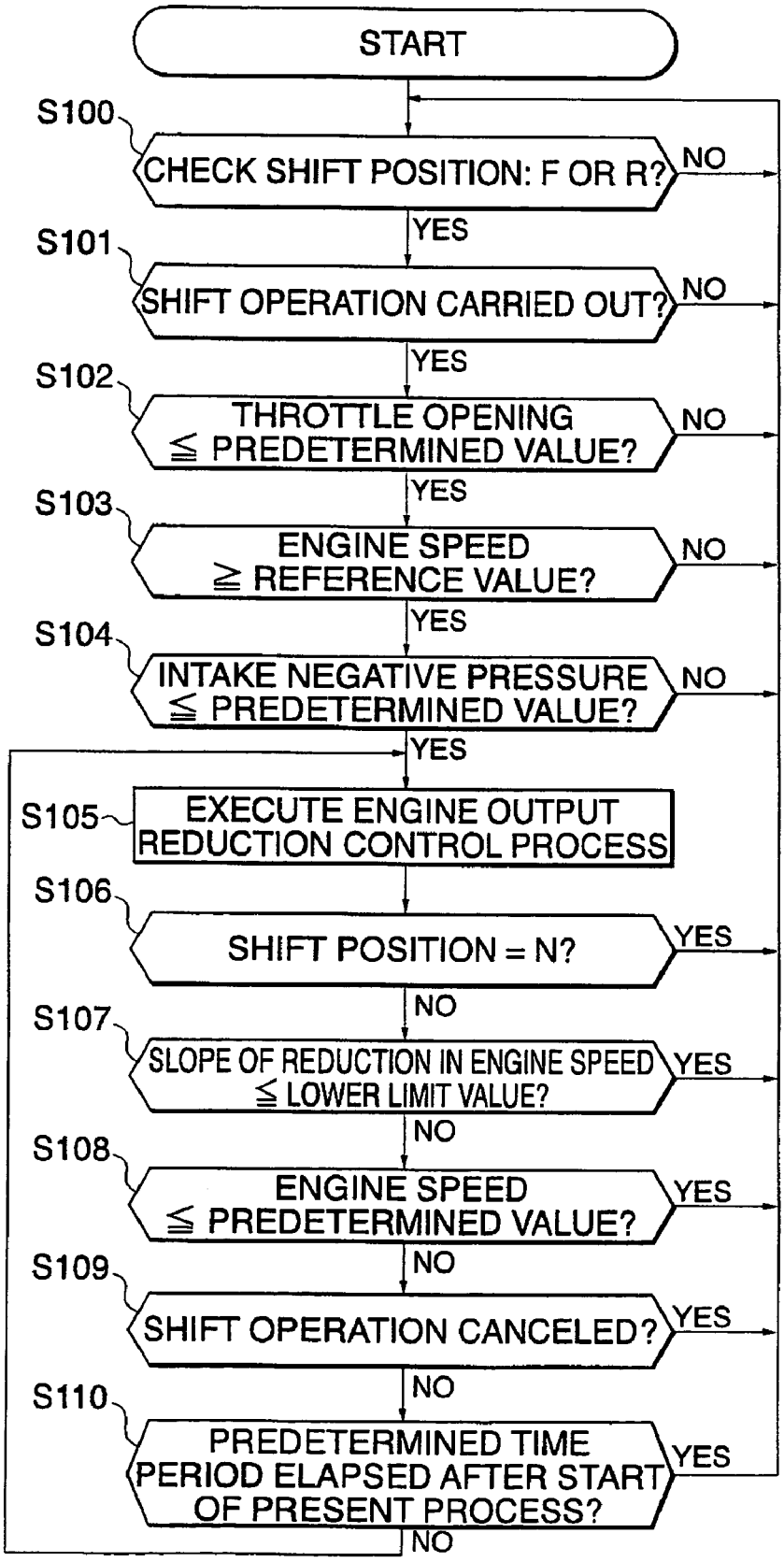
FIG. 8 is a flowchart showing an engine output reduction control process for the outboard motor in FIG. 1.
Figure 9:
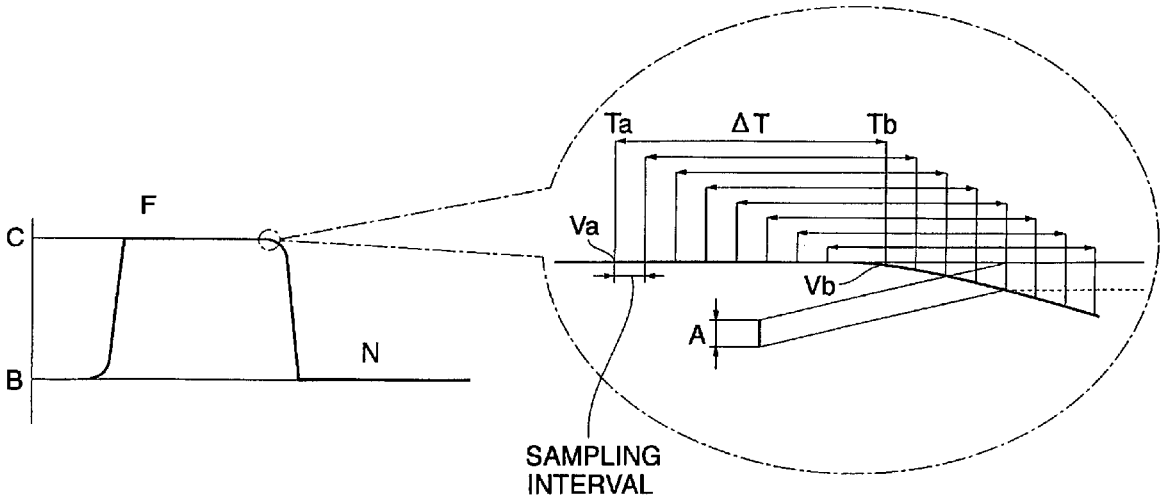
FIG. 9 is a diagram useful in explaining a method of detecting a shift operation based on the output from the shift position detector.

FIG. 8 is a flowchart showing an engine output reduction control process for the outboard motor 1. This process is executed by the CPU 31 of the control system 30 based on a predetermined program stored in the ROM of the CPU 31.

As shown in FIG. 8, first, the CPU 31 determines based on the output from the shift position detector 24 whether or not the shift operation lever 21 is in the F position or in the R position (i.e. whether the shift operation lever 21 is in a position other than the N position) (step S100).

Next, when the shift operation lever 21 is in the F position or in the R position, the CPU 31 determines whether or riot the operator has performed a shift operation (step S101). To reduce the operating force applied to the shift operation lever 21 when the shift operation lever 21 is shifted from the F position or the R position to the N position, it is of key importance to detect the shift operation intended by the operator in earlier timing and more accurately. To this end, not only the shift position of the shift operation lever 21 being shifted but also the amount of change in the output from the shift posit-on detector 24 occurring when the shift operation is performed is detected.

Due to assemblage errors of the shift position detector 24 and variations in tolerances of the associated component parts, it is difficult to promptly detect the shift position only from a determination of the position (absolute value) of the shift operation lever 21 being shifted. Further, in view of aging of the shift operation detector 24 and the associated component parts (change in the output due to wear of the component parts, variable resistor, and so forth), a correct determination cannot be carried out only from the absolute value of the shift position.

Figure 10:
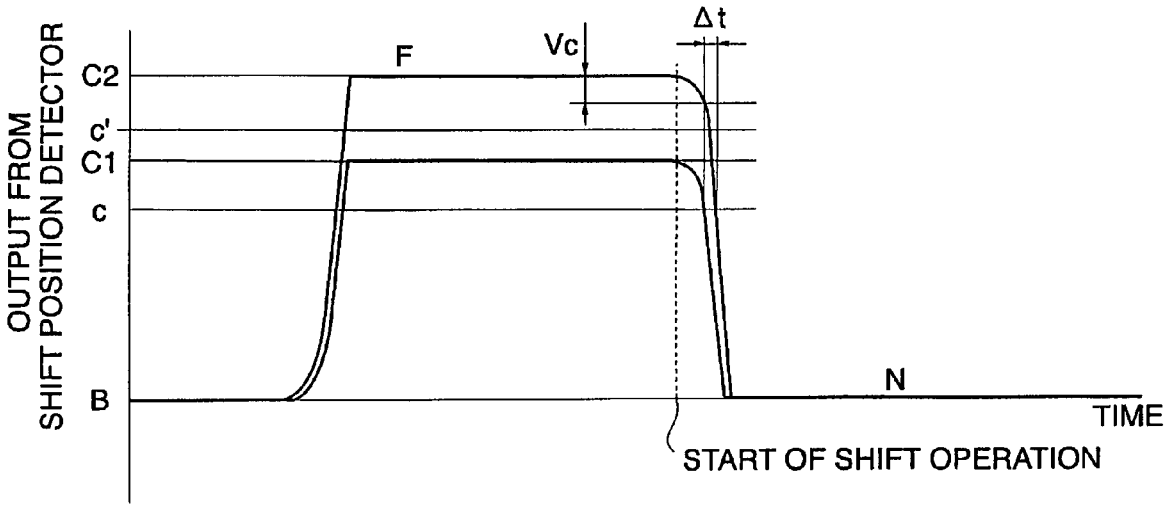
FIG. 10 is a diagram useful in explaining another method of detecting a shift operation based on the output from the shift position detector.

For example, as shown in FIG. 10, assuming that the output from the shift position detector 24 when the shift operation lever 21 is in the F position varies between an output C1 and an output C2 due to assemblage errors or the shift position detector 24 and variations in tolerances of the associated component parts, if the detection of a shift operation is carried out with reference to a predetermined absolute value c for shift operation determination, a delay of $\Delta t$ in shift operation detection timing is caused by the output C2 compared with the case of the output C1. In this case, in spite of a substantial change in the output from the shift position detector 24 (the operating force is accumulated in component parts in the force transmission path from the remote control box 20 to the dot clutch, such as the cables and links), the shift operation cannot be detected, and therefore the engine output change control function does not start to work, resulting in the operator being required to exert a very large operating force. Further, if the shift operation is detected with reference to another absolute value c', the output C1 is erroneously detected as indicating the N position.

To overcome the above problem, a comparison is made between the present value of the output from the shift position detector 24 and a value of the same detected a predetermined time period earlier. More specifically, the output from the shift position detector 24 is measured at short sampling time intervals (e.g. 10 ms), and an amount of change (Va−Vb) between an output voltage Vb in the present timing (time point) Tb and an output voltage Va in timing (time point) Ta earlier than the present timing Tb by a predetermined time period (e.g. 200 ms) is calculated, and when the amount of change in the output is not smaller than a predetermined value A (e.g. 100 mV), it is determined that a shift operation has been performed. This prevents a momentary change in the output caused by noise or some external force (impact) or the like applied on the shift position detector 24 from being erroneously detected as a shift operation having been performed.

Further, the control system 30 may be provided with a learning function, i.e. the capability of learning the output value from the shift position detector 24 when the shift operation lever 21 is in the F position or in the R position, and when the output from the shift position detector 24 is changed from the learned value by not less than a predetermined value Vc, it may be determined that a shift operation has been performed. As the method of learning the output value, when the same output value is detected a predetermined number of times when the shift operation lever 21 is in the F position, the output value is learned as the learned value for the F position. For example, as shown in FIG. 10, the output voltage C2 from the shift position detector 24 is set to the learned value, and when the output voltage C2 from the shift position detector 24 is changed by not less than the predetermined value Vc, it is determined that a shift operation has been performed. Even when the value of the output voltage from the shift position detector 24 when in the F position is changed to the output voltage C1 due to aging or the like, the output voltage C1 is set to the learned value by the learning function, it is possible to detect a shift operation with accuracy.

Further, the output from the shift position detector 24 when the shift operation lever 21 is in the F position or the R position is constantly measured at very short sampling time intervals, and when the measured value is changed by an amount not less than the predetermined value Vc, it may be determined that a shift operation has been performed. For example, as shown in FIG. 10, the output voltage C2 from the shift position detector 24 may be measured as a normal output at predetermined time intervals and stored, and when the output voltage C2 from the shift position detector 24 is changed by not less than the predetermined value Vc, it may be determined that a shift operation has been performed. In this case, even when the normal output from the shift position detector 24 is changed to the output voltage C1 due to aging or the like, it is possible to accurately detect the shift operation with accuracy.

As described above, by constantly determining the present shift position of the shift operation lever 21 based on the output from the shift position detector 24, and constantly detecting the amount of change in the output from the shift position detector 24, it is possible to detect a shift operation as soon and accurately as possible.

Next, it is determined whether or not the throttle opening is not larger than a predetermined opening (small opening) (step S102).

In the case of outboard motors, normally, a part of the outboard motor mounted on a fixed mounting part (clamp bracket or the like) or the stern of a hull is displaced with respect to the fixed mounting part due to propeller thrust of the outboard motor at rapid acceleration. Further, a fixed part that fixes in position a throttle cable for opening and closing the throttle and a fixed part that fixes in position a shift cable for performing the shift operation are disposed close to each other, and when the throttle is rapidly fully opened, these fixed parts are sometimes displaced by slight amounts. In such a case or when an external force is applied to the fixed parts due to a jump of the boat during running, the shift position detector 24 detects the displacement to erroneously detect that a shift operation has been performed, though no actual shift operation has been performed.

To overcome the problem of such an erroneous detection, in the present embodiment, the engine output reduction control process is carried out only when the throttle opening is not larger than the predetermined opening (small opening).

In a general outboard motor, a throttle and shift operation mechanism is provided in which a remote control box is used to perform the throttle operation and the shift operation by a single common shift operation lever. Specifically, by moving the shift operation lever forward from the neutral position, the shift position is shifted to the forward position, and then, as the shift operation lever is tilted forward from the forward position, the throttle can be operated from a fully closed position to a wide open position.

Conversely, by moving the shift operation lever rearward from the neutral position, the shift position is shifted to the reverse position, and then, as the shift operation lever is tilted rearward from the reverse position, the throttle can be operated from the fully closed position to a medium position. Due to this structure, in the case of outboard motors, when a shift operation is performed, the throttle is substantially fully closed irrespective of whether the engine speed is high or low. Therefore, by carrying out the engine output reduction control process only when the throttle opening is not larger than the predetermined opening, it is possible to eliminate the inconvenience of erroneously detecting a displacement occurring at rapid acceleration as a shift operation.

Next, the engine speed is detected, and it is determined whether or not it is necessary to carry out the engine output reduction control process (step S103 in FIG. 8). This is because when the engine speed is not higher than a predetermined value the drive torque of the engine is also low, and therefore the engine output reduction control process reed not be carried out.

Then, it is determined whether or not intake negative pressure is not higher than a predetermined negative value (step S104). That is, if the throttle is rapidly closed for rapid deceleration when the engine is in a steady operating condition in a medium-to-high engine speed region, the engine speed largely drops even without execution of the engine output reduction control, and hence it is easy to perform the shift operation. Further, execution of the engine output reduction control under such a condition of the engine may cause engine stalling, and therefore there is no need to carry out the engine output reduction control process.

On the other hand, at a throttle snap in which the throttle is rapidly opened and then rapidly closed (rapid acceleration→rapid deceleration) or the like, the engine speed cannot immediately follow up the rapid opening and closing of the throttle, so that without execution of the engine output reduction control process, it is necessary to apply a large operating force for performing the shift operation immediately after such a throttle snap.

To eliminate this inconvenience, in the present embodiment, the intake pressure is detected when a shift operation is detected to thereby distinguish between a rapid deceleration from a steady operating condition in a medium-to-high engine speed region and a rapid deceleration caused by a throttle snap.

When the throttle is rapidly closed from the medium-to-high engine speed region, even after the throttle valve is closed to reduce the intake air amount, the engine speed progressively lowers while maintaining the engine speed to some level, so that the intake negative pressure becomes very large. Therefore, by detecting the intake pressure upon detection of a shift operation, it is possible to distinguish between a rapid deceleration from a steady operating condition in a medium-to-high engine speed region and a rapid deceleration caused by a throttle snap.

As another embodiment, it is also possible to determine whether or not the engine output reduction control should be executed, by determining the engine operating condition before the throttle is rapidly closed, e.g. whether or not the operation of the engine in a medium-to-high engine speed region has continued for not less than a predetermined time period.

Next, in a step S105 in FIG. 8, the engine output reduction control process, i.e. the engine output reduction control through misfiring control is carried out.

After detection of the shift operation, it is necessary to decrease the engine speed as soon as possible insofar as engine stalling is prevented from occurring. The demand for rapidly reducing the engine speed is contradictory to the requirement of prevention of engine stalling, and in addition, in the case of the outboard motor 1, the hull in which the outboard motor 1 is installed and the propeller which is mounted on the outboard motor 1 can vary in construction, and therefore it is necessary to control the engine speed to an optimum value dependent on the hull (size, weight, and loadage of the boat) in which the outboard motor 1 is installed.

Therefore, in reducing the engine output, it is effective to carry out the misfiring control (interruption of an ignition signal) starting with a cylinder to be ignited immediately after detection of the shift operation, instead of specifying in advance cylinders to be misfired, of the engine 5. The method of reducing the engine output is not limited to the misfiring control, but it is also possible to control the fuel injection amount or the intake air amount (an intake air bypass amount) to thereby reduce the drive torque of the engine. However, in the control of the fuel injection amount and the intake air amount, the changed fuel injection amount or the changed intake air amount does not take effect to reduce the drive force only few combustion cycles until after the start of the control, when the changed amount of fuel or intake air enters the combustion chamber. In contrast, the ignition control (misfiring control or ignition timing retardation control) is very effective since the drive force (torque) starts to be reduced immediately after the start of the control.

According to the present engine output reduction control, when the shift operation is detected, the engine speed is detected by the crank angle signal detector 40, and the misfiring control (ignition signal interruption) is carried out depending on the engine speed detected at the time.

TABLE 1

| | Engine Speed Region (rpm) | | | | | |
|---|---|---|---|---|---|---|
| | N1 | N2 | N3 | N4 | N5 | N6 |
| Number of Consecutive Misfires | A | B | C | D | E | F |

Figure 11A:
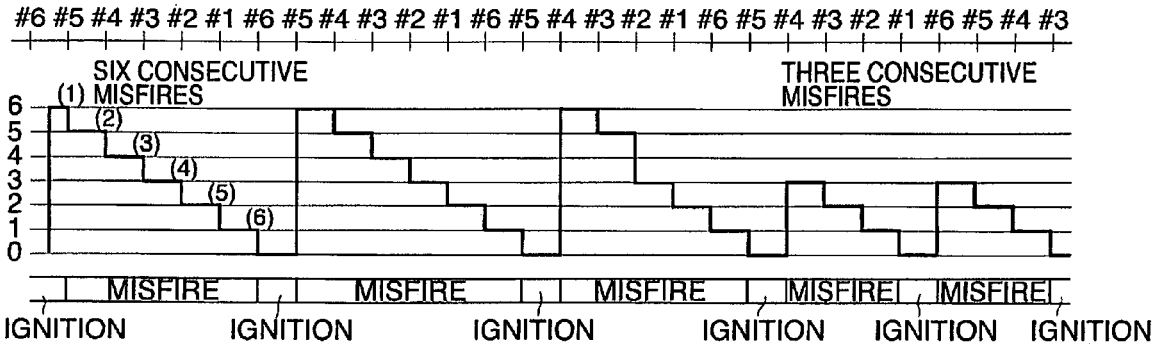

For example, assuming that the engine speed detected upon detection of the shift operation is 2800 rpm which belongs to an N5 region of the engine speed, the misfiring control is immediately carried out by setting the number of consecutive misfires to a number E. For example, when E=6 holds, as shown in FIG. 11A, the misfiring control is started with the ignition timing of the next cylinder to be ignited ((1) in FIG. 11A), and misfire is caused six consecutive times (#5→#4→#3→#2→#1→#6), and then the next cylinder (#5) is ignited. Thereafter, six consecutive misfires are carried out in the same manner. This misfiring control reduces the engine speed, and when the engine speed is in an N4 engine speed region in Table 1, the number of consecutive misfires is changed to a number D (e.g. D=3), to execution of three consecutive misfires. The settings in Table 1 are configured depending on the types of the engine 5 and the propeller 7 which are mounted on the outboard motor 1, and the hull in which the outboard motor 1 is installed.

On the other hand, when the engine speed is rapidly reduced during the consecutive misfiring control, engine stalling can occur. Therefore, an allowable slope of reduction in the engine speed (an amount of drop in the engine speed per ignition) as shown in Table 2 is set on an engine speed region-by-engine speed region basis, and when the detected slope of reduction in the engine speed exceeds the set allowable value (predetermined value), the number of consecutive misfires is automatically changed.

TABLE 2

| | Engine Speed Region (rpm) | | | | | |
|---|---|---|---|---|---|---|
| | N1 | N2 | N3 | N4 | N5 | N6 |
| Predetermined Values of Deceleration for Changing Number of Misfires | a | b | c | d | e | f |

Figure 11B:
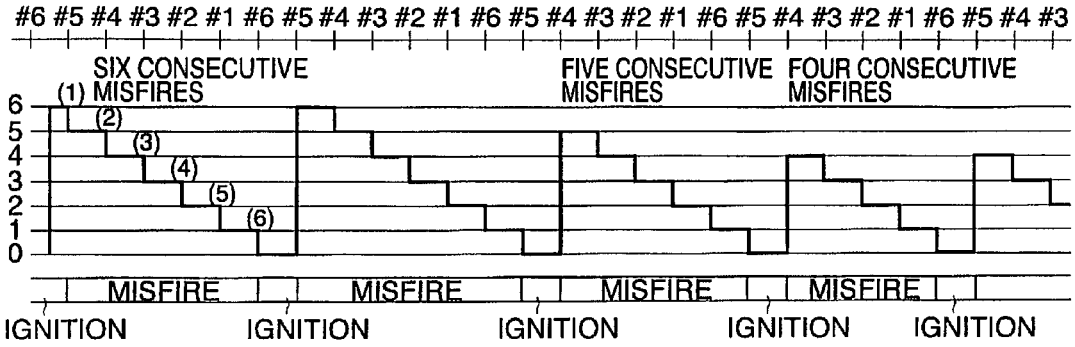

The CPU 31 calculates a degree of deceleration (slope of reduction in the engine speed) during the misfiring control, and when the calculated value exceeds a predetermined value ("a" to "f") in Table 2, the number of consecutive misfires is automatically changed from X to (X−1) For example, as shown in FIG. 11B, when the degree of deceleration exceeds a predetermined value "e" when six consecutive misfires are being executed with the engine speed being in the N5 region, more specifically, when the engine speed drops by not less than 300 rpm during one ignition (misfire), the setting of the consecutive misfiring is changed from the six consecutive misfires to (6-1) i.e. five consecutive misfires. If the degree of deceleration still exceeds the predetermined value "e", the setting is further changed to (5-1) consecutive misfires. It is also possible to change the setting to (X−n (n: 2, 3, . . . )). The settings in Table 2 are configured depending on the types of the engine 5 installed in the outboard motor 1 and the like, similarly to Table 1.

Further, a lower limit value of the slope of reduction in the engine speed is set on an engine speed region-by-engine speed region basis, as shown in Table 3, and when the detected slope exceeds the lower limit value, the engine speed reduction control is canceled.

TABLE 3

| | Engine Speed Region (rpm) | | | | | |
|---|---|---|---|---|---|---|
| | N1 | N2 | N3 | N4 | N5 | N6 |
| Lower Limit Values of Deceleration for Cancelling Misfiring Control | g | h | i | j | k | l |

The CPU 31 calculates the degree of deceleration during the misfiring control, and when the calculated value exceeds the lower limit value ("g" to "l") in Table 3, the engine output reduction control is canceled. For example, when the degree of deceleration exceeds a predetermined value "k" when the six consecutive misfires are being executed with the engine speed being in the N5 region, more specifically, when the engine speed drops by not less than 500 rpm during one iginition (misfire), it is judged that engine stalling will occur, so that the engine output reduction control is immediately canceled (step S107, referred to hereinafter). The settings in Table 3 are set depending on the types of the engine 5 installed in the outboard motor 1 and the like, similarly to Tables 1 and 2.

Although in the embodiment described above, during the engine output reduction control, the consecutive misfiring control is carried out based on the settings in Tables 1 to 3, the method of reducing the engine output is not limited to the misfiring control, but the engine output may be reduced by changing the ignition timing to a predetermined retardation value which is set on an engine speed region-by-engine speed region basis.

By the way, when the shift operation is detected, if the engine speed is low (e.g. the engine speed is in the N1 region), the engine output is small, and the required shift operating force is also small, so that it is not necessary to carry out the misfiring control consecutively a plurality of times. In this low engine speed region, to improve the shift feeling instead of reducing the shift operating force, timing is predicted in which the dog clutch 9*d* is disengaged from the forward gear 9*b* or the reverse gear 9*c* to set the neutral position, and based on the prediction, misfiring control or ignition timing retardation control is carried out.

In this respect, in the present embodiment, the timing in which the engine output reduction control is executed is varied depending on whether the engine speed is high or low (trawling). More specifically, when the engine speed is high, the shift operation is detected as soon and accurately possible, and the torque (engine output) is reduced as soon as possible so as to reduce the engine speed. In contrast, when the engine speed is low, since the danger of engine stalling increases if the misfiring control is consecutively executed a plurality of times, so that the timing in which one-time misfiring or ignition timing retardation is executed is made coincident with the timing in which the dog clutch 9*d* is disengaged from the forward gear 9*b* or the reverse gear 9*c* to set the neutral position (misfiring or ignition timing retardation is carried out immediately before the shift position is set to the neutral position).

Therefore, according to the present embodiment, when the engine speed is low, the timing in which the dog clutch 9*d* is disengaged to set the neutral position is predicted (calculated) from a ratio of change in the output (slope of change in the output) from the shift position detector 24.

Figure 12A:
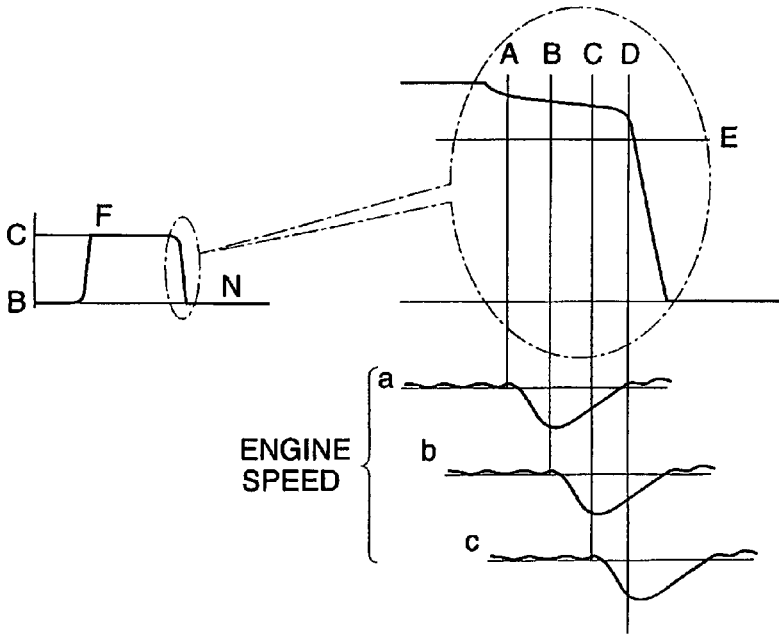
Figure 12B:
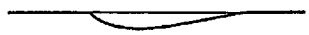

FIGS. 12A and 12B are diagrams useful in explaining timing of the engine output reduction control (execution timing thereof), in which FIG. 12A is a diagram showing an example of timing in which the engine output reduction control is carried out when a shift operation is detected, and FIG. 12B is a diagram showing an example of the output from the shift position detector when an erroneous operation is carried out.

In FIG. 12A, reference symbol A designates timing in which the shift position detector 24 detects the shift operation, and reference symbol D designates timing in which the dog clutch 9*d* is actually disengaged from the forward gear 9*b* to set the neutral position.

Reference symbol "a" designates a change in the engine speed occurring when the engine output reduction control is executed immediately after the shift operation is detected by the shirt position detector 24. In this case, only after the engine output is reduced to reduce the engine speed and then the engine speed is recovered by termination of the engine output reduction control, the dog clutch 9*d* is disengaged from the forward gear 9*b* to set the neutral position. Therefore, the shift operating force for the shifting operation cannot be reduced.

In contrast, reference symbol "c" designates a change in the engine speed occurring when the timing D is calculated (predicted) in which the dog clutch 9*d* is to be disengaged from the forward gear 9*b* to set the neutral position, based on the ratio of change in the output from the shift position detector 24 from the timing A to the timing D, and the engine output reduction control starts to be carried out in timing C. In this case, in timing in which the dog clutch 9*d* is disengaged from the forward gear 9*b* to set the neutral position, the engine output reduction control process is carried out to reduce the engine speed, so that the shift operating force for the shift operation can be reduced.

Further, when the engine speed is low, a sufficient time margin is allowed after the timing A in which the shift operation is first detected and before the timing C in which the engine output reduction control is carried out, so that whether the shift operation is being continued is determined even after the shift operation is detected through calculation from the ratio of change in the output from the shift position detector 24, to thereby increase the accuracy of detection of the shift operation, and from the ratio of change, timing in which the dog clutch 9*d* is to be disengaged from the forward gear 9*b* to set the neutral position is predicted (calculated). This control makes it possible to prevent erroneous control from being carried out when a slight displacement of the shift operation lever 21 not intended by the operator who grips the shift operation lever 21 (throttle and shift lever) is detected (e.g. as shown in FIG. 12B).

On the other hand, when the engine speed is in a low speed region, the shift operation lever 21 of the remote control box 20 is in the vicinity of a fully closed throttle position and hence in a region permitting a shift operation, and therefore the output from the shift operation detector 24 changes due to a slight displacement of the shift operation lever 21. Therefore, although the motion of the operator who grips the shift operation lever 21 (a motion of the operator when he does not intend to carry out the shift operation) can be erroneously detected as the shift operation, only a displacement of the shift operation lever 21 continuously occurring over a predetermined time period is determined as the shift operation through the above control, which makes it possible to detect a displacement of the shift operation lever 21 intended by the operator for performing the shift operation in a manner discriminated from the displacement of the same not intended by operator.

Among shift operations at low engine speed, a shift operation for shifting from the F position to the N position, and further to the R position is carried out by the operator with a positive intention, so that the shift operating force for performing the shift operating force is strong and hence the ratio of change in the output from the shift position detector 24 is large.

When the engine speed is in a medium speed region, the shift operation lever 21 of the remote control box 20 is in a position corresponding to the throttle being open, and the remote control box 20 is configured such that in the above state of the throttle, the shift operation lever 21 is immovable. Therefore, the motion of the operator holding the shift operation lever 21 is not transmitted to the shift position detector 24.

Next, when the shift position detector 24 detects that the shift position has been switched to the N position (YES to the step S106 in FIG. 8), the engine output reduction control is canceled. Whether or not the shift position is the N position can be determined by providing a predetermined threshold value E, as shown in FIG. 12A. However, the shift position can vary due to assemblage errors and the tolerance of component parts, and further, the position where the shift position is switched to the N position can vary even with the same engine, depending on the shift operating force applied to the shift operation lever for performing the shift operation, and therefore the most accurate detection can be carried out when the shift position is at a point (timing D in FIG. 12A) where the amount of change in the output from the shift position detector 24 largely changes. This point corresponds to the moment where the dog clutch 9*d* is disengaged from the forward gear 9*b* to set the neutral position, and the shift operation lever 21 is suddenly pivotally moved.

Further, when the slope of reduction in the engine speed exceeds the lower limit value (YES to the step S107), the engine output reduction control is immediately canceled. Further, even when the engine speed drops below the predetermined value (YES to the step S108), the engine output reduction control is canceled.

When the slope of change in the output from the shift position detector 24 is inverted, it is judged that the shift operation has been canceled midway during the shift operation (YES to the step S109), and the engine output reduction control is canceled.

Further, in anticipation for the case where the conditions for canceling the control are not satisfied due to failure of the shift operation detector 24, the crank angle signal detector 40, etc., a predetermined upper limit control time period is provided. Normally, the shift operation is completed in a short time period (Δt seconds), and therefore, if the control continues longer than such a short time period, it is judged that there exists some abnormality, and the engine output reduction control is forcibly canceled before engine stalling occurs (YES to the step S110). For example, the above predetermined upper limit control time period is set to about three times longer (3Δt seconds) than the time period over which the shift operation is normally carried out.

Although in the above-described embodiment, the shift position detector 24 is disposed at the first-actuated rotary part of the shift mechanism, it may be disposed at any location insofar as the location is between the remote control box 20 and the dog clutch 9*d* in the outboard motor 1. However, between the remote control box 20 and the dog clutch 9*d*, the remote control cable 22 and a lot of linkages are disposed, so that due to the presence of a play and hysteresis of each of these component parts, it is desirable to dispose the shift operation detector 24 at a location closer to the operator, i.e. the remote control box 20.

Figure 13:
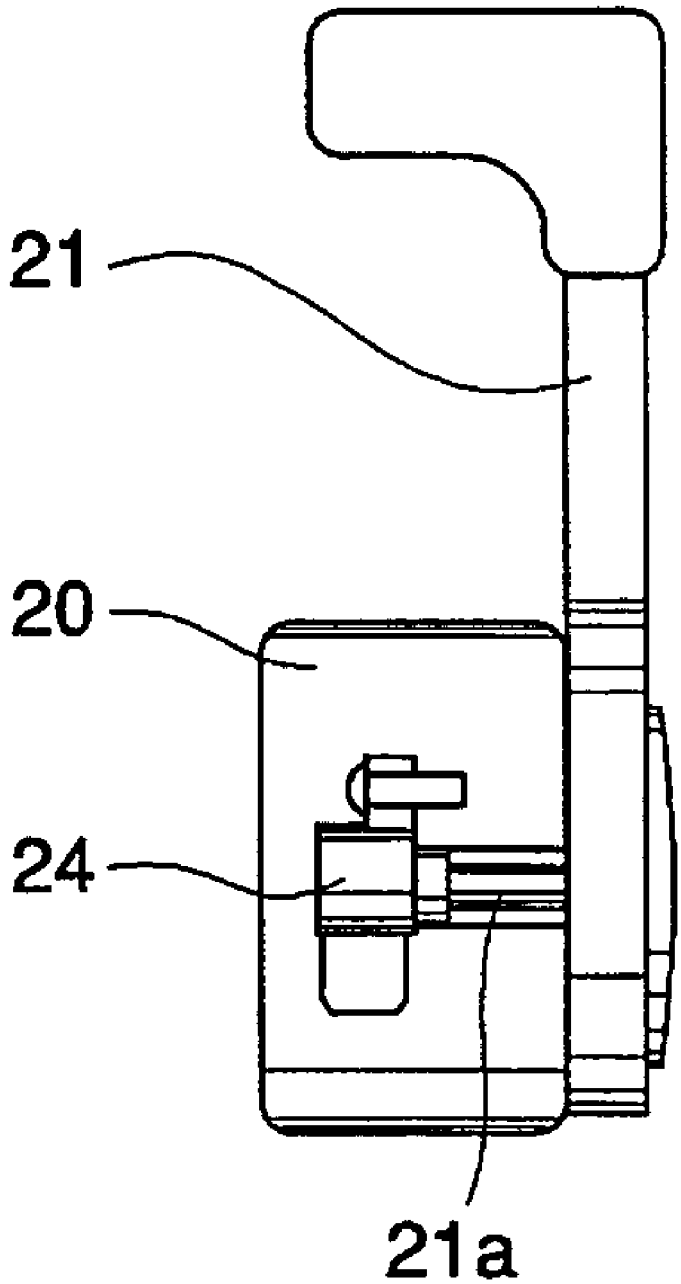
FIG. 13 is a schematic diagram showing another example of the disposition of the shift position detector.
Figure 14A:
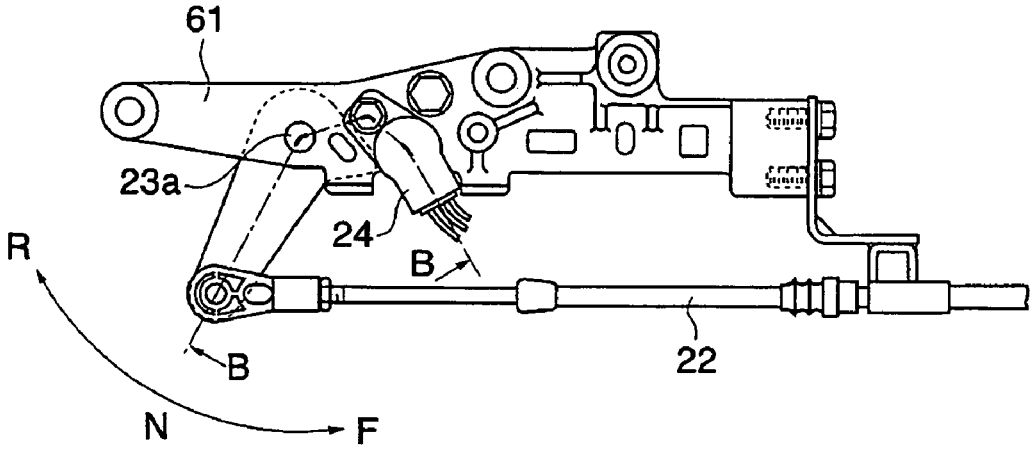
Figure 14B:
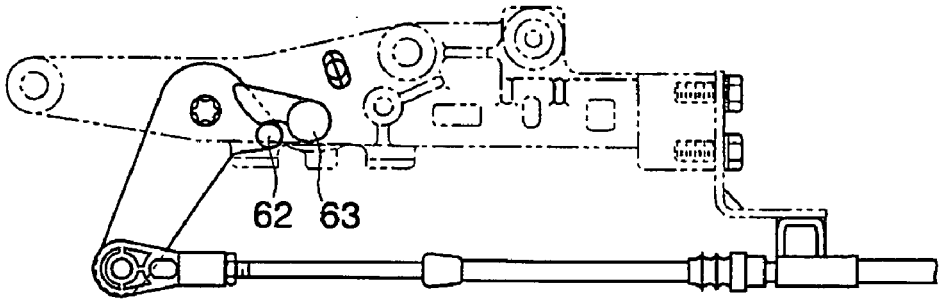
Figure 14C:
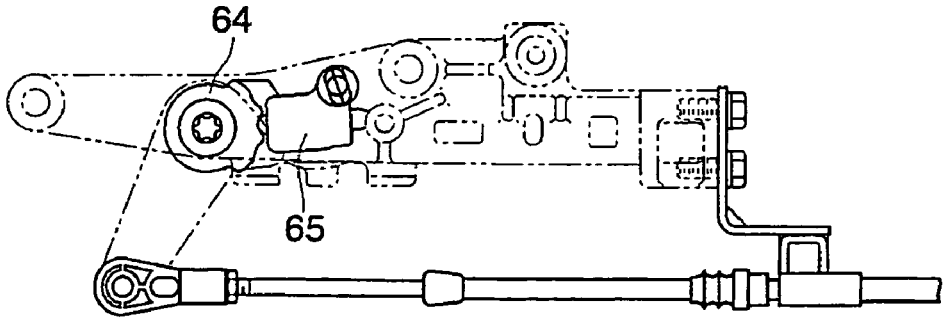

FIG. 13 is a schematic diagram showing another example of the disposition of the shift position detector 24.

As shown in FIG. 13, the shift position detector 24 is disposed such that the pivot of the rotary variable resistor 24 is directly coupled to the pivot 21*a* of the shift operation lever 21. This makes it possible to detect the shift operation earlier and more accurately. Further, as described hereinabove, the shift operation lever 21 of the remote control box 20 is also adapted to carry out operations for opening and closing the throttle, providing the merit that not only the shift operation but also the throttle opening can be detected at the same time.

FIGS. 14A to 14C and FIGS. 15A and 15B are schematic diagrams showing still another example of the disposition of the shift position detector 24.

In FIGS. 14A to 14C and FIGS. 15A and 15B, reference numeral 23*a* designates a shift lever pivot, 61 a forward/reverse switching mechanism-forming bracket, 62 a detection lever-pivoting protrusion fixed to the shift lever 23, 63 a detection lever, 64 a detent plate as a wave-shaped plate for generation of a click at each shift position, 65 a ball and spring-contained component part for setting the click in the shifting operation, and 66 a detection lever fixing plate.

Figure 15A:
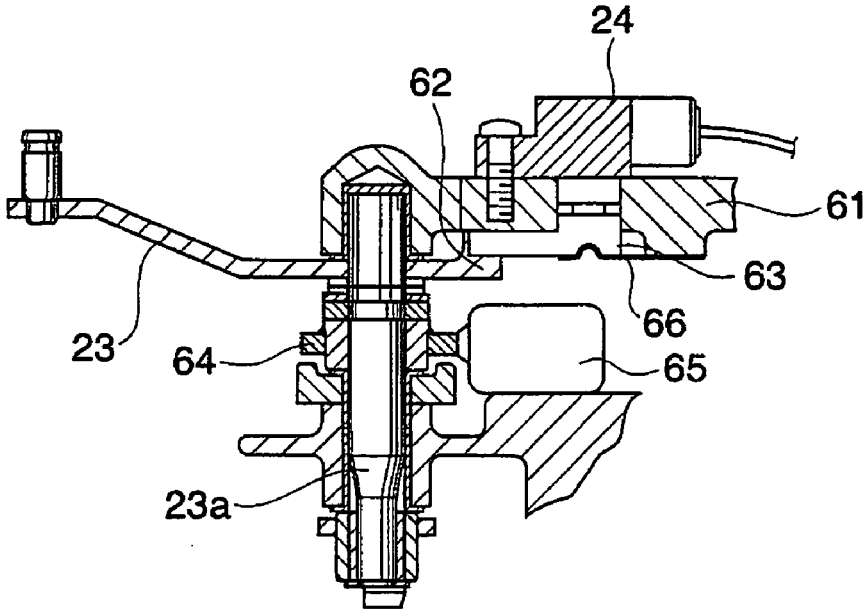
Figure 15B:
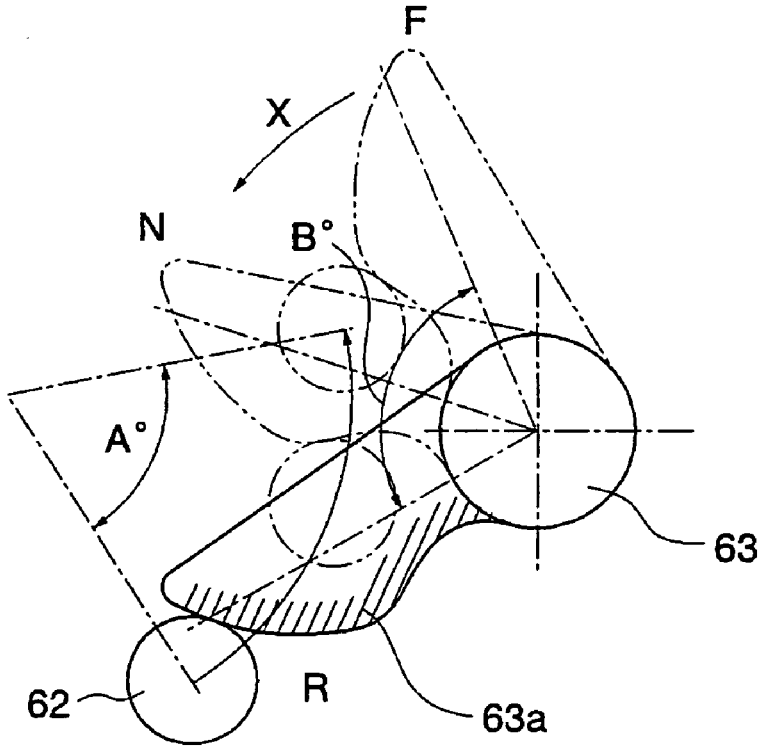

The detection lever 63 is fixed to the variable resistor pivot within the shift position detector 24, and is urged against the shift lever-pivoting protrusion 62 in an anticlockwise direction by a spring mechanism in the shift position detector 24, as indicated by the arrow X in FIG. 15B. With this arrangement, the detection lever-pivoting protrusion 62 which pivotally moves together with the shift lever 23 pivotally moves the detection lever 63 about the variable resistor pivot, whereby the shift operation can be detected.

A contact surface 63*a* of the detection lever 63 in contact with the detection lever-pivoting protrusion 62 is formed as a curved surface, which is advantageous in that the detection lever 63 can be designed in the amount of rotation (angle) with some freedom with respect to the amount of rotation (angle) of the shift lever 23. This also makes it possible to increase the detecting resolution only in regions of angles particularly important for the shift detection (e.g. only regions where the shift position is changed from F to N, from R to N, etc.). For example, for a 1-degree change of the shift lever position, the detection lever 63 may be pivotally moved through an increased angle only in the particular regions, whereby a nonlinear characteristic of the output from the shift position detector 24 can be obtained as shown in FIG. 5.

Further, this arrangement has the merit that the lever ratio of the detection lever 63 can be designed as desired, and the angle of movement of the detection lever 63 (angle B° in FIG. 15B) can be made larger with respect to the angle of movement of the shift lever 23 (angle A° in FIG. 15B), thus enabling the use of the maximum pivotal angle range of the variable resistor.

Further, in the present arrangement, the pivot of the shift lever 23 is not directly connected to the pivot of the variable resistor, built the spring mechanism is provided to absorb vibrations, to thereby prevent wear of the variable resistor pivot and wear of the internal resistance material and the brush caused by vibrations and provide excellent vibration resistance for the shift operation detector 24. At the same time, the shift operation detector 24 has a freedom of disposition thereof, and a compact construction can be realized which makes use of unused (available) space in the engine.

As described above, according to the present embodiment, the shift operation by the shift operation lever 21 is continuously detected by the shift position detector 24, and when an early stage of the shift operation from the forward position to the neutral position or from the reverse position to the neutral position is detected, the engine output reduction control is carried out if the engine speed at the time of detection is not less than a predetermined value, and when the shift position detector 24 detects that the shift position has been switched to the neutral position, the engine output reduction control is canceled. Therefore, when the shift operation is at an early stage, i.e. the shift operation lever 21 is in a state before the operator increases the shift operating force applied to the shift operation lever 21, and at the same time the engine speed is not less than the predetermined value, i.e. when it is predicted that the shift operating force applied to the shift operation lever 21 is to increase, the engine output is reduced, whereby an operating force smaller than that required in the prior art is sufficient to perform the shift operation, thus facilitating the shift operation.

Further, when the shift position detector 24 detects the early stage of the shift operation, and at the same time the throttle opening is not smaller than a predetermined value, control is performed to change the engine output. As a result, an erroneous detection of the shift operation can be prevented, which may be made when an external force other than the shift operating force for performing the shirt operation acts on the shift operation lever 21 e.g. at a rapid acceleration or upon a jump of the boat during running.

Further, when the shift operation detector 24 detects the early stage of the shift operation, and at the same time the intake negative pressure is not higher than a predetermined value, control is performed to change the engine output, which makes it possible to avoid an increase in the shift operating force occurring when the engine speed cannot immediately follow up sudden opening or closing of the throttle at a throttle snap.

Further, when the shift position detector 24 detects that the shift position is in the vicinity of the forward position or the reverse position, and at the same time, the amount of change in the detected shift position is not less than a predetermined value, the CPU 31 determines that the shift operation is in its early stage. As a result, it is possible to accurately and promptly determine whether or not the shift operation is being carried out, by preventing erroneous detection or delayed detection of the shift operation due to assemblage errors of the shift operation detector 24 and variations in the output thereof.

Further, the CPU 31 changes the engine output by carrying out firing control based on the number of consecutive misfires or the ignition timing retardation value set on an engine speed region-by-engine speed region basis. As a result, the engine output can be reduced while preventing engine stalling under various conditions.

Further, the CPU 31 sets the allowable slope of reduction in the engine speed with respect to each predetermined number of times of ignition, and when the set allowable slope of reduction exceeds a predetermined value, the number of consecutive misfires or the ignition timing retardation value is changed. This makes it possible to ensure the advantageous effects of promptly reducing the engine output while preventing engine stalling.

Also, the CPU 31 sets the lower limit value of the allowable slope of reduction in the engine speed per each predetermined number of times of ignition, and when the slope of reduction in the engine speed exceeds the set lower limit value, the control for changing the engine output is canceled. This makes it possible to prevent engine stalling during changing of the engine output.

Further, the shift position detector 24 is disposed at the first-actuated driving part of the forward/reverse switching mechanism 9 inside the outboard motor 1. As a result, it is possible to accurately detect the shift operation by the operator without being influenced by a play or hysteresis of the forward/reverse-switching mechanism 9 inside the outboard motor 1.

Further, the shift position detector 24 is disposed close to the driving part of the shift operation lever 21 disposed in the remote control box 20 for remotely controlling the forward/reverse-switching mechanism of the outboard motor 1. This makes it possible to detect the shift operation by the operator in earlier timing with higher accuracy without being influenced by a play or hysteresis of lots of linkages disposed between the remote control box 20 and the outboard motor 1.

Although in the first embodiment described above, the step S101 in FIG. 8 is executed before the steps S102 to S104 are executed, it may be executed after execution of the step S104. Further, the order of execution of the steps S102 to S104 is not limited to the description given with reference to FIG. 8.

Next, a description will be given of a second embodiment of the present invention. In the first embodiment described above, the shift operation by the shift operation lever 21 is continuously detected by the shift position detector 24, and when an early stage of the shift operation from the forward (F) position to the neutral (N) position or from the reverse (R) position to the neutral (N) position is detected, the engine output reduction control is carried out. The second embodiment is distinguished from the first embodiment in that when an early stage of a shift operation from the neutral (N) position to the forward (F) position or from the neutral (N) position to the reverse (R) position is detected, the engine output reduction control is carried out. The other parts of the configuration of the present embodiment are the same as those of the first embodiment, and therefore detailed description thereof is omitted. In the following description, the elements and parts which correspond to those of the first embodiment are designated by identical reference numerals.

Figure 16:
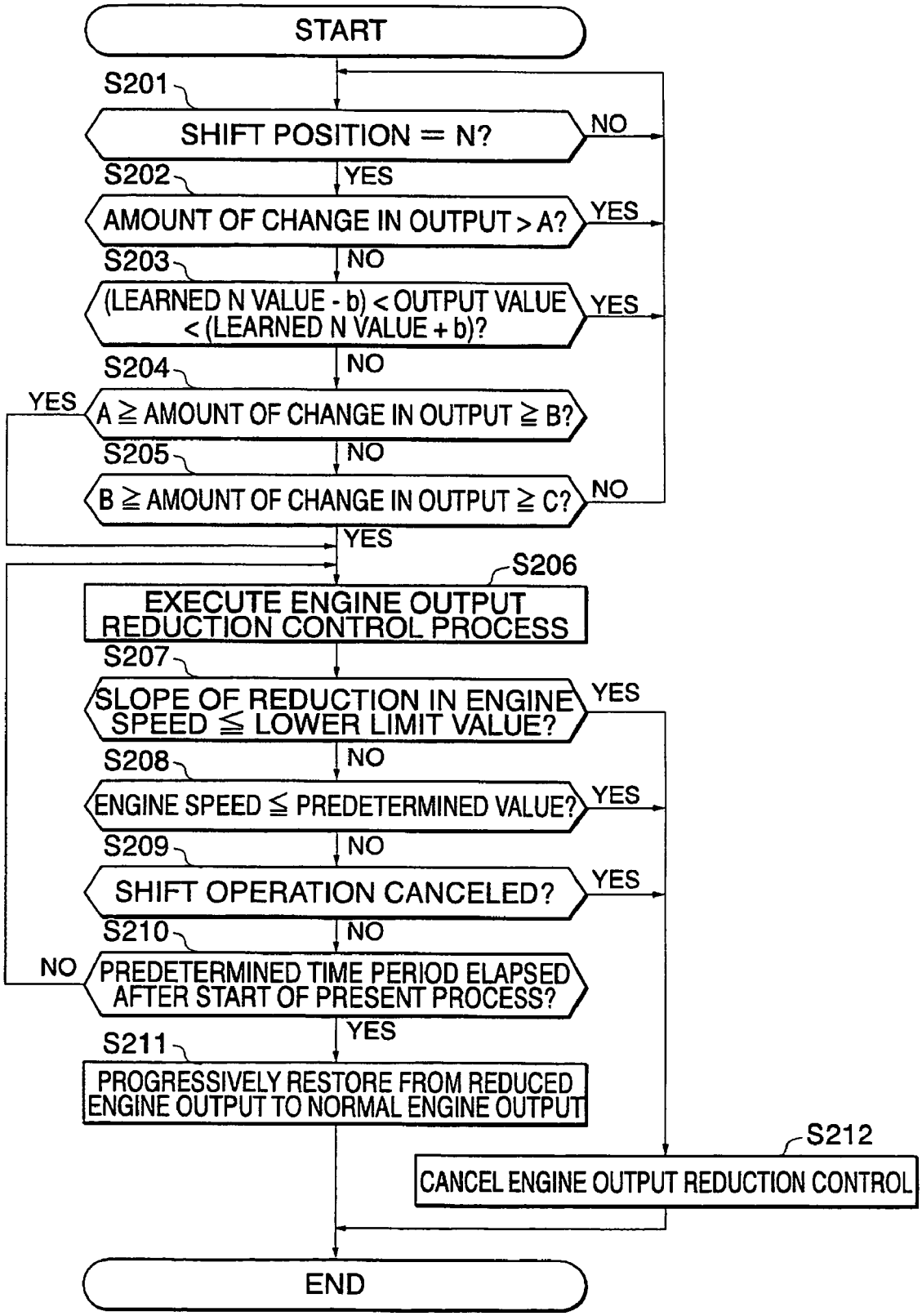
FIG. 16 is a flowchart showing an engine output reduction control process carried out by a shift operation control system according to a second embodiment of the present invention.

FIG. 16 is a flowchart showing an engine output reduction control process carried out by a shift operation control system according to the second embodiment. This process is executed by the CPU 31 based on a predetermined program stored in the ROM of the CPU 31.

As shown in FIG. 16, first, the CPU 31 determines, based on the output from the shift position detector 24, whether or not the shift operation lever 21 is in the neutral (N) position (step S201). If the result of the determination shows that the shift operation lever 21 is in the N position, it is determined whether or not the shift operation has been carried out by the operator (steps S202 to S205).

As stated above as to the first embodiment, due to variations caused by assemblage errors of the shift position detector 24 and tolerances of the associated component parts, and aging, it is difficult to promptly detect the shift position only from a determination of the position (absolute value) resulting from the shift operation.

Figure 17A:
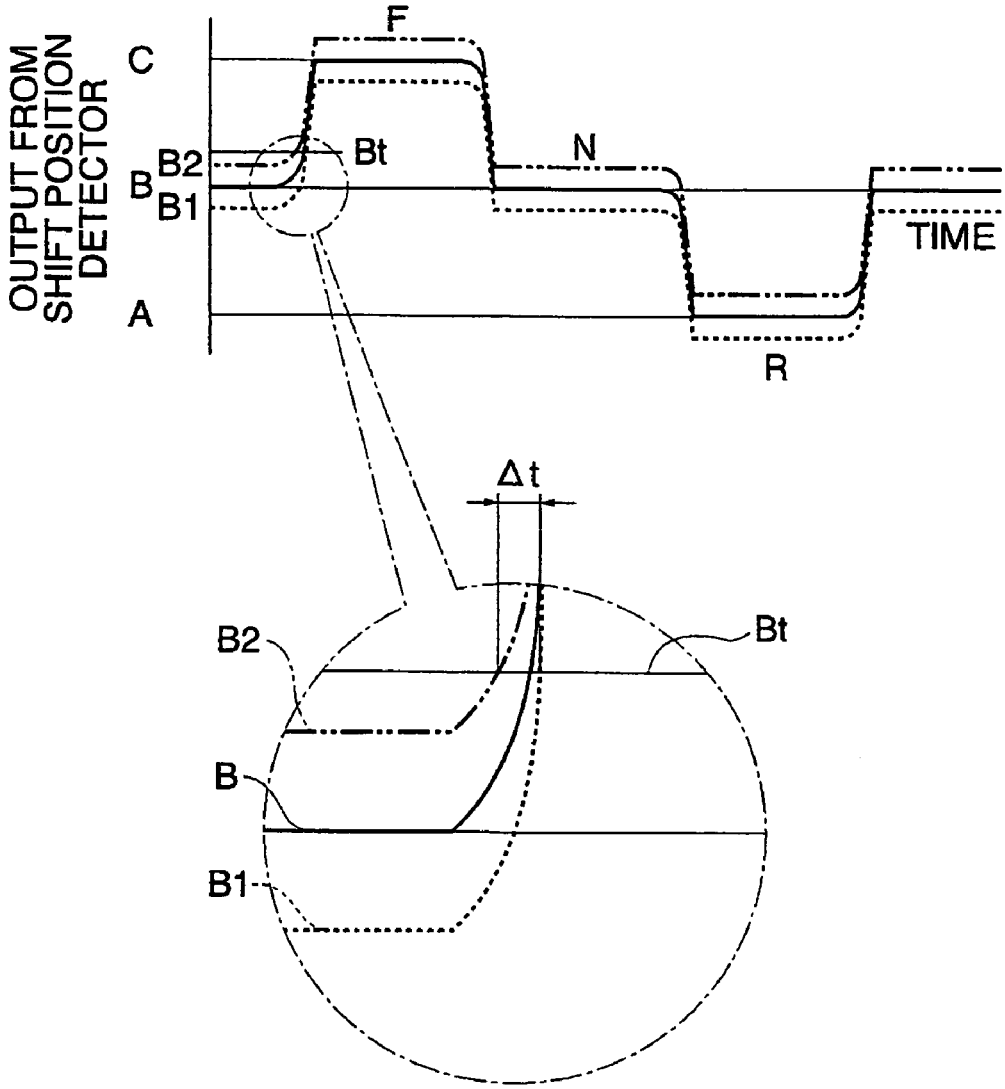
FIG. 17A is a diagram useful in explaining a method of detecting a shift operation based on the output from the shift position detector.

For example, as shown in FIG. 17A, assuming that the output from the shift position detector 24 when the shift operation lever 21 is in the N position varies from an output B1 to an output B2, if the detection of the shift operation is carried out with reference to a predetermined absolute value Bt for shift operation determination, a delay of Δtin shift operation detection timing is caused by the output B1 compared with the case of the output B2.

Figure 17B:
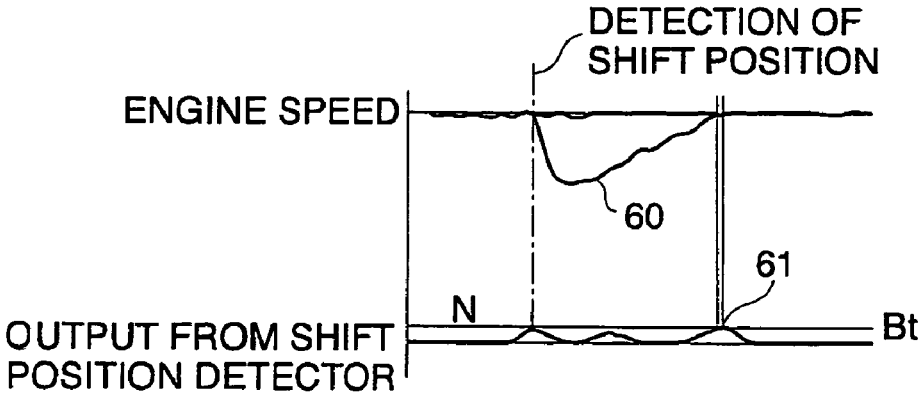
FIG. 17B is a diagram showing changes in the engine speed when the output from the shift position detector is changed.

On the other hand, if the output from the shift position detector 24 assumes the output B2, there arises the inconvenience of erroneously detecting a subtle movement of the shift operation lever 21 causes by a load unconsciously applied to the shift operation lever 21 or the like, as the shift operation being carried out. For example, when the operator grips the shift operation lever 21 by hand, as shown in FIG. 17B, the load unconsciously applied to the shift operation lever 21 or the like changes the output from the shift operation detector 24. If the engine output reduction control, described hereinafter, is carried out upon detection of the change, a change in the engine speed not intended by the operator is produced as indicated by reference numeral 60. Further, as indicated by reference numeral 61 in FIG. 17B, even when the shift position is brought back to the N position after detection of the shift operation, a change occurs in the engine speed.

Figure 18:
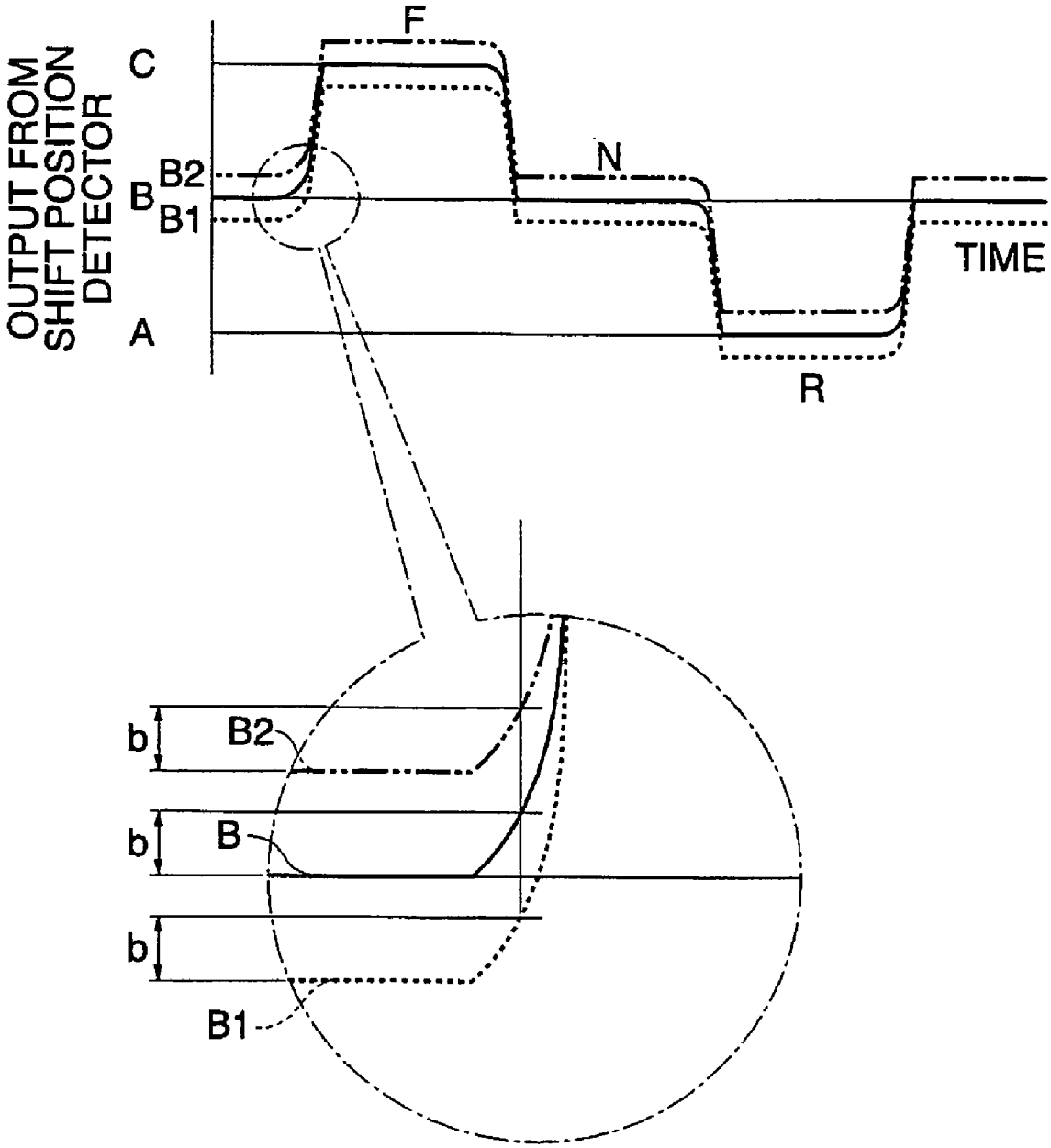
FIG. 18 is a diagram useful in explaining the method of detecting a shift operation, employed by the shift operation control system according to the second embodiment.

To avoid these inconveniences, as shown in FIG. 18, the output from the shift position detector 24 (e.g. the value B1 or B2) produced when the shift position is the N position is stored as a learned neutral (N) value, and insensitive zones each having a margin b are set for the learned N value, and when the output from the shift position detector 24 goes beyond the insensitive zone, and at the same time the amount of change in the output from the shift position detector 24 exceeds a predetermined value A, it is determined that a shift operation has been carried out from the N position to the F position (or from the N position to the R position).

The learned N value is stored as the output value of the shift position detector 24 when the output from the shift position detector 24 is within the range of "b" to "c" in FIG. 5, and the amount of change in the output voltage from the shift position detector 24 has continued to be within a predetermined range over a predetermined time period. For example, assuming that the initial value of the learned N value is designated by b1, and the present output value from the shift position detector 24 is designated by b2 (b2<b1), and if the output voltage has been stable in the vicinity of the value b2 with the amount of change remaining within the above predetermined range, a value obtained by subtracting a predetermined very small value b3 from the value b1 is set to a new learned N value (learned N value=b1−b3).

On the other hand, assuming that the output from the shift position detector 24 is designated by b4 (b4>b1), and has continued to be stable in the vicinity of b4 for a predetermined time period with the amount of change in the output voltage remaining within the predetermined range, a value obtained by adding the value b3 to the value b1 is set to a new learned N value (learned N value=b1+b3). By repeatedly carrying out this process, the learned N value converges, and even if the output value when the shift position is the N position has changed due to aging or the like, the new learned N value is set by the learning function, so that it is possible to promptly and accurately detect whether or not the shift operation has been carried out.

Further, as indicated by reference numeral 61 in FIG. 17B, even when the shift operation lever 21 is brought back to the N position after detection of the shift operation, a change occurs in the engine speed. Therefore, when the output from the shift position detector 24 goes beyond the insensitive zone having the margin b, and at the same time the amount of change in the output from the shift position detector 24 exceeds the predetermined value, it is determined that a shift operation has been carried out.

Figure 19:
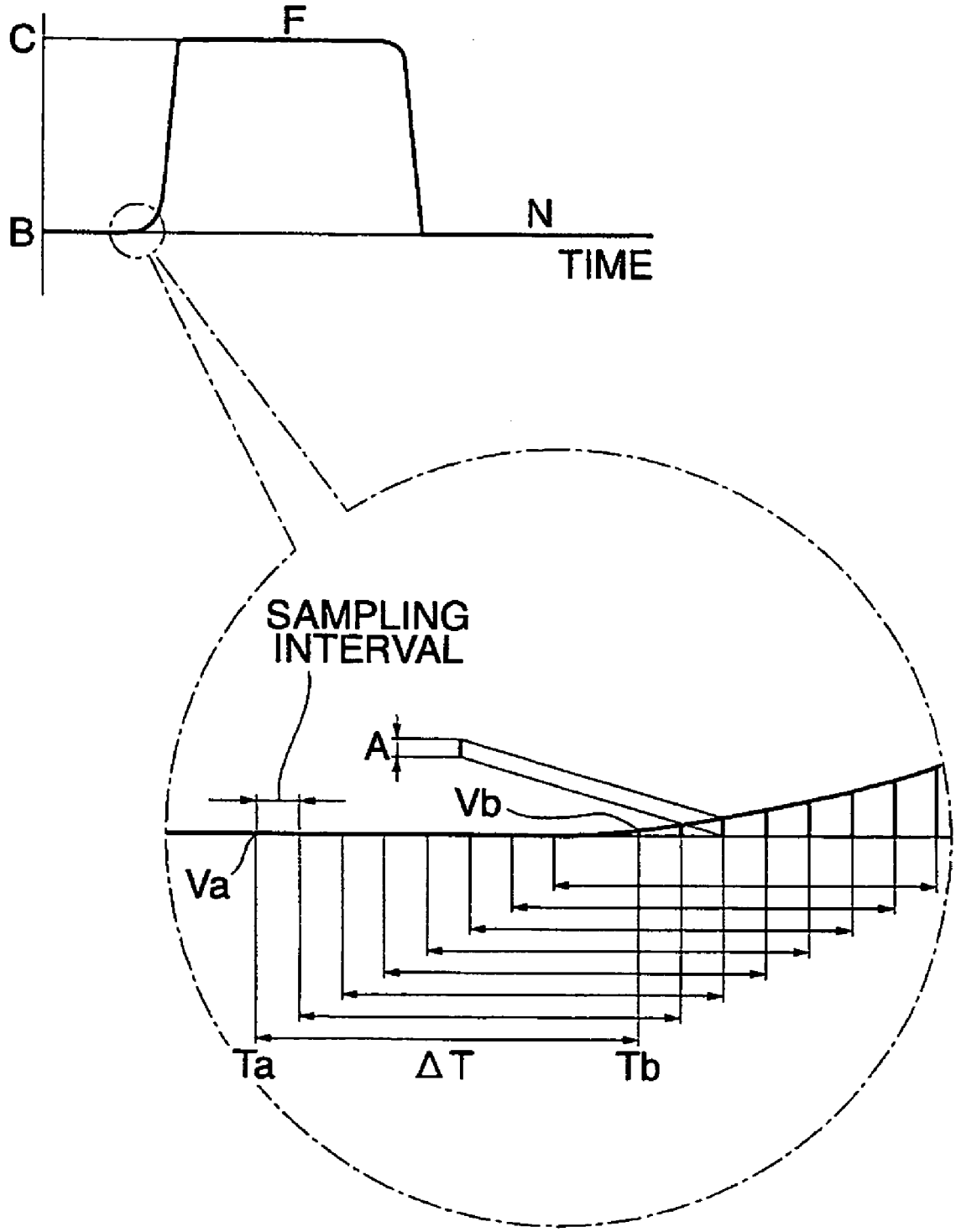
FIG. 19 is a diagram useful in explaining another method of detecting a shift operation based on the output from the shift position detector.

The comparison between output values from the shift position detector 24 is made not between the present value and the immediately preceding value of the output from the shift position detector 24, but between the present value and a value detected a predetermined time period earlier. More specifically, as shown in FIG. 19, the output from the shift position detector 24 is measured at short sampling time intervals (e.g. 10 ms), and an amount of change (Va−Vb) between an output voltage Vb in the present timing (time point) Tb and an output voltage Va in timing (time point) Ta earlier than the present time point Ta by a predetermined time period (e.g. 200 ms) is calculated, and when the amount of change in the output is not smaller than the predetermined value A (e.g. 100 mV) in the increasing direction (in the decreasing direction when switched from the N position to the R position), it is determined that a shift operation has been carried out.

This makes it possible to provide control such that even when the output from the shift position detector 24 has changed beyond the insensitive zone set for the learned N value with the margin b, the engine output reduction control is not readily carried out. To prevent an erroneous detection due to noise or an external force (impact) applied to the shift position detector 24, it may be consecutively determined a plurality of times whether or not the amount of change in the output is not smaller than the predetermined value A.

Figure 20:
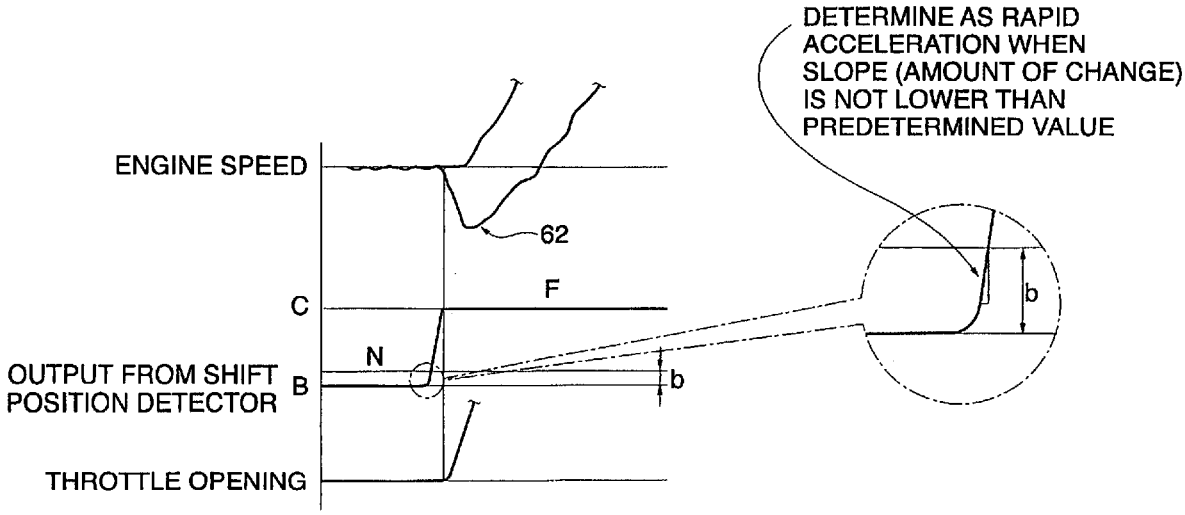
FIG. 20 is a diagram useful in explaining timing of engine output reduction control carried out at rapid acceleration.

Referring again to FIG. 16, in a step S202, a shift operation speed is detected from the amount (slope) of change in the output, and it is determined whether or not the shift operation speed is larger than the predetermined value A (amount of change in the output>A). If the result of the determination shows that the predetermined value A is exceeded (YES to the step S202), it is determined that rapid acceleration is being carried out, and then the present process returns to the step S201. This is because if the engine output reduction control is carried out during rapid acceleration in which the shift operation from the N position to the F position is rapidly carried out, as shown in FIG. 20, the engine speed once drops to cause a stumble or unstable engine rotation 62, resulting in degraded accelerability. To avoid this inconvenience, within the insensitive zone as well, when the amount of change in the output from the shift position detector 24 exceeds the predetermined value A, it is judged that rapid acceleration is being performed, so that the engine output reduction control is not carried out.

In the case of outboard motors, the same lever is used both for the shift operation and the throttle operation, and accordingly, when rapid acceleration is carried out from the N position, as shown in FIG. 20, the output from the shift position detector 24 suddenly changes before the throttle is suddenly opened. Therefore, from the amount (slope) of change in the output from the shift position detector 24, it is possible to distinguish the rapid acceleration from a shift operation under a steady condition.

When the amount of change in the output from the shift position detector 24 does not exceed the predetermined value A (NO to the step S202), it is determined whether or not the output value from the shift position detector 24 is larger than (learned N value−b) and smaller than (learned N value+b) (step S203). This determines, as described above, whether or not the output value from the shift position detector 24 is within the insensitive zone having the margin b set for the learned N value.

If the result of the determination in the step S203 shows that the output value from the shift position detector 24 is not within the range of (learned N value−b) to (learned N value+b), it is determined whether or not the amount (slope) of change in the output is not larger than the predetermined value A and not smaller than a predetermined value B (step S204). The predetermined value B (B<A) is an arbitrary value set for detecting the slope of change in the output from the shift position detector 24 to predict shift IN timing. Further, as shown in FIG. 19, the amount of change in the output is determined by a comparison of the present value with the output value produced the predetermined time period earlier. The predetermined time period is rather short, and when it is shortest, it is equal to the sampling time period. Therefore, the amount of change in the output can be regarded as a value having the same meaning as the slope of change in the output from the shift position detector 24, so that the slope may be used in place of the amount of change. However, when using the slope, the predetermined values A and B should be also replaced by respective values for use with the slope. If the result of the determination in the step S204 shows that the amount (slope) of change in the output is within the range of the predetermined value A to the predetermined value B), it is determined that a shift operation, has been carried out, and the process proceeds to a step S206.

On the other hand, the result of the determination in the step S204 shows that the amount (slope) of change in the output is not within the range of the predetermined value A to the predetermined value B) (NO to the step S204), it is further determined whether or not the amount (slope) of change in the output is smaller than the predetermined value B and not smaller than a predetermined value C (step S205). This determines whether or not the shift operation speed is low. The predetermined value C is an arbitrary value set in association with the values A and B (A>B>C).

If the result of the determination in the step S205 shows that the amount (slope) of change in the output is not within the range of the predetermined value B to the predetermined value C) (NO to the step S205), it is judged that the shift operation speed is low, and then the process returns to the step S201 so as to detect the shift operation a plurality of times. This makes it possible to improve the accuracy in the detection of the shift operation.

On the other hand, if the result of the determination in the step S205 shows that the amount (slope) of change in the output is within the range of the predetermined value B to the predetermined value C) (YES to the step S205), it is judged that a shift operation has been carried out, and the process proceeds to the step S206. Also when the amount of change in the output is reduced to 0 or the slope of the change in the output is an opposite slope, the engine output reduction control is not carried out, either.

Next, in the step S206, the engine output reduction control is carried out.

After the shift operation is detected, it takes a very short time to switch the shift position from the N position to the F position, so that it is necessary to reduce the engine speed as promptly as possible insofar as engine stalling is prevented. To attain this goal, it is effective to instantly carry out the ignition timing retardation control (or misfiring control) for the engine 5 starting with the cylinder which is to be ignited immediately after the shift operation is detected without specifying cylinders to be subjected to the ignition timing retardation control (or misfiring control).

In the present engine output reduction control, even after the shift position is switched from the N position to the F position, the engine output reduction control is continued for a while to reduce the engine speed, and thereafter the engine speed is progressively recovered to the normal rotational speed, more specifically, the retarded ignition timing is progressively restored to the normal ignition timing, whereby a shock caused by the shift operation is further reduced.

The method of reducing the drive torque of the engine is not limited to the ignition timing retardation control or the misfiring control described above, but the control of fuel injection amount or the intake air amount (control of the bypass intake air) may be carried out to reduce the drive torque. However, with the control of the fuel injection amount or the intake air amount, the changed fuel injection amount or the changed intake air amount enters the combustion chamber to reduce the drive force only few combustion cycles after the start of the control. In contrast, the ignition control (misfiring control or ignition timing retardation control) is very effective since the drive force starts to be reduced immediately after the start of the control.

Figure 21:
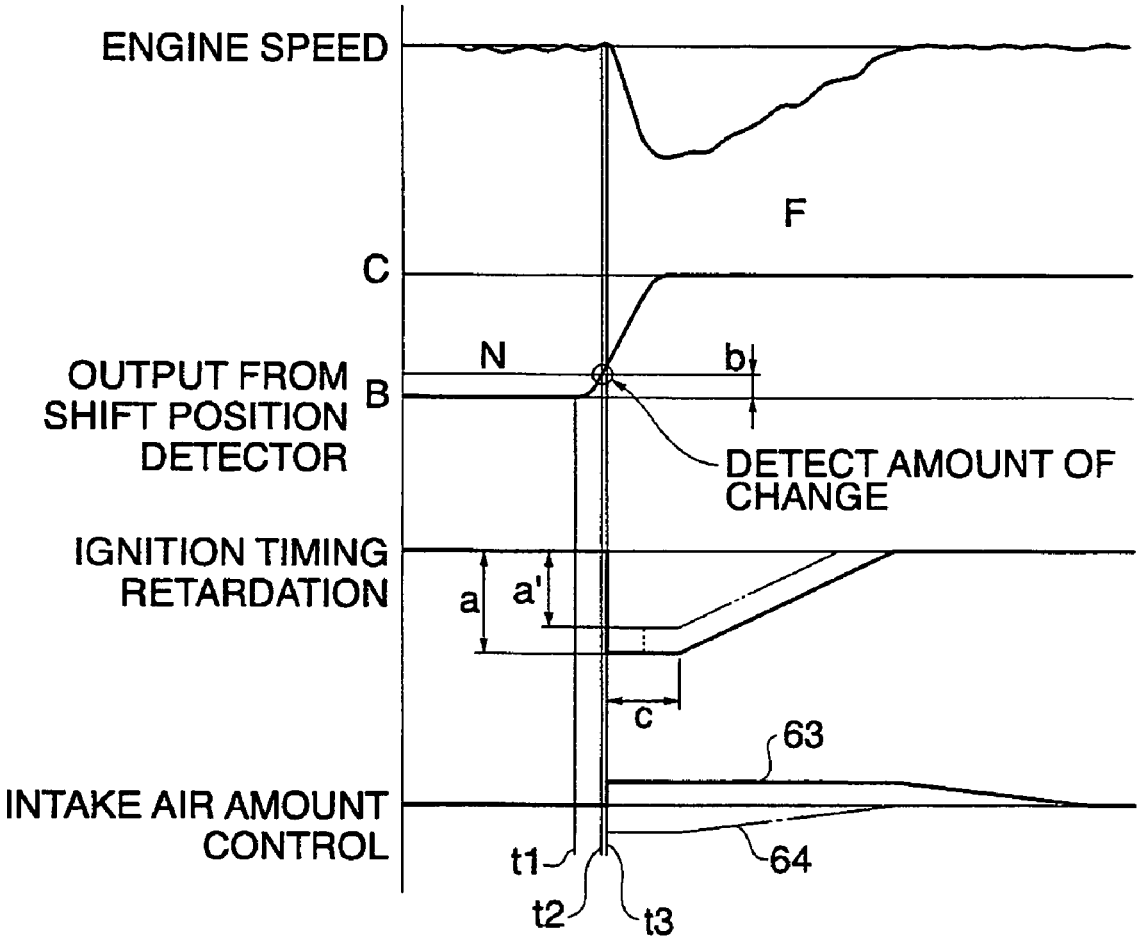
FIG. 21 is a diagram useful in explaining timing of the engine output reduction control (execution timing thereof) when an shift operation is detected.

FIG. 21 is a timing diagram useful in explaining the engine output reduction control process.

In FIG. 21, reference numeral t1 designates a time point the shift operation is started, t2 a time point the output value goes beyond the insensitive zone, and t3 a time point the amount of change in the output exceeds the predetermined value in the increasing direction.

In the present engine output reduction control, as shown in FIG. 21, when the shift operation is detected at the time point t3, the normal ignition timing is immediately retarded by a predetermined amount (ignition timing retardation amount "a") to carry out the ignition timing retardation control.

On the other hand, if the engine speed is suddenly reduced during execution of the ignition timing retardation control, there is a possibility of engine stalling. To prevent engine stalling, an allowable slope of reduction in the engine speed (amount of drop in the engine speed per each ignition) is set (a predetermined reference drop value per each ignition is set), and the amount of the drop in the engine speed is constantly detected through calculation. When the amount of drop in the engine speed is larger than the predetermined drop value, to prevent engine stalling, the ignition timing retardation amount is changed from the amount "a" to the amount "a'" to change the controlled variable in the engine output reduction control.

Further, to prevent engine stalling, the intake air amount may be controlled as indicated by reference numeral 63 in FIG. 21. When the intake air amount control is carried out, the ignition timing retardation (or misfiring) is executed, and at the same time the intake air amount is increased (reference numeral 63 in FIG. 21) in anticipation for a sudden drop in the engine speed during the shift operation (e.g. when load from the propeller is high).

When the load from the propeller is high and the amount of drop in the engine speed is larger than the predetermined drop value, there is a fear of engine stalling, and therefore the engine output reduction control is canceled and the ignition timing control is carried out to restore the retarded ignition timing to the normal ignition timing or advance the ignition timing, and at the same time, the intake air amount increased in advance is controlled, for prevention of engine stalling.

The control of the intake air amount is not employed during the engine output reduction control in which the instant engine output reduction (with a large effect) is necessary, since the changed intake air amount enters the combustion chamber to reduce the drive force only few combustion cycles after the start of the control.

Figure 22A:
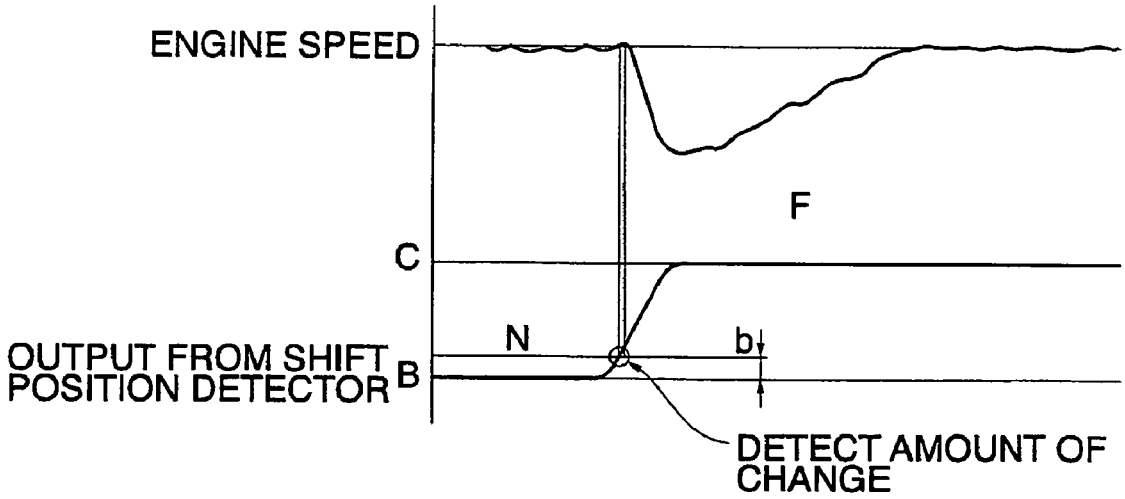
FIG. 22A is a diagram useful in explaining timing in which the engine output reduction control is carried out when the shift operation speed is high.
Figure 22B:
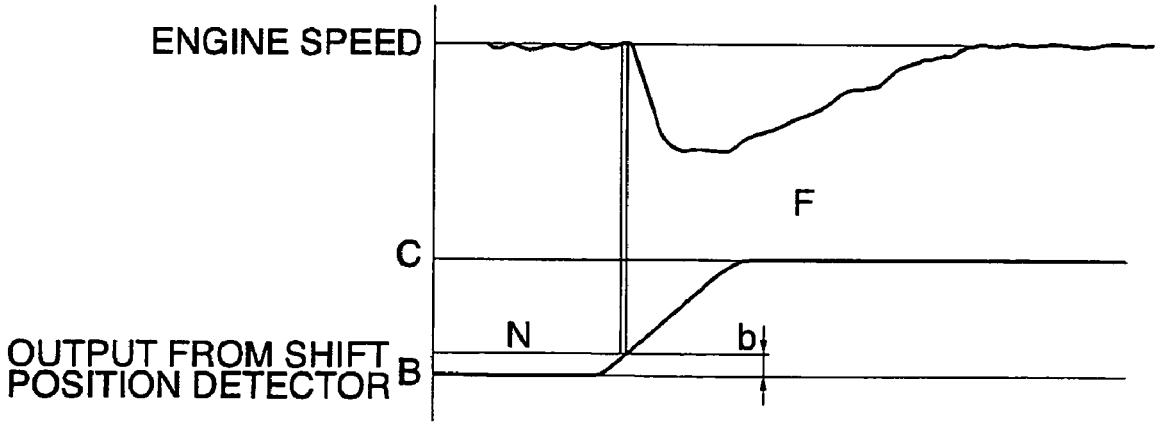
FIG. 22B is a diagram useful in explaining timing in which the engine output reduction control is carried out when the shift operation speed is low.

In the present engine output reduction control, the shift operation speed may be detected from the amount (slope) of change in output from the shift position detector 24, and the controlled variable in the engine output reduction control may be changed according to the shift operation speed. As shown in FIG. 22B, when the shift operation speed is low, it is preferable to carry out the detection of the shift operation a plurality of times. On the other hand, as shown in FIG. 22A, when the shift operation speed is high, it is determined that rapid acceleration is being carried out.

Further, in the present engine output reduction control, the controlled variable of the engine output reduction control may be changed depending on the warmed-up condition of the engine. When the engine is cold, the engine has increased friction. Therefore, it is determined whether or not the engine is warmed up, from the engine temperature or the coolant temperature, and if the engine is warmed up, the controlled variable of the engine output reduction control is changed.

Moreover, during the engine output reduction control, tachometer output is controlled. More specifically, though for a short time period, during the engine output reduction control, the engine speed becomes much lower than the normal idling speed so that the pointer of the tachometer largely drops to give a sense of disorder or uneasy feeling to the operator. To eliminate this inconvenience, during the engine output reduction control, the tachometer output is controlled so as to prevent the pointer from indicating an engine speed value lower than a predetermined value.

After execution of the engine output reduction control, when the amount of drop in the engine speed is larger than the predetermined drop value, the controlled variable in the engine output reduction control is reduced. Further, when the amount of drop in the engine speed is larger than a predetermined threshold value, the engine output reduction control is canceled, and engine output increase control is carried out as required.

Referring again to FIG. 16, when the amount of drop in the engine speed (slope of reduction in the engine speed) exceeds the lower limit value (YES to a step S207), there is a fear of engine stalling, and therefore the engine output reduction control is immediately canceled. Further, when the engine speed becomes lower than a predetermined value (YES to a step S208), the engine output reduction control is cancelled.

Moreover, when the slope of change in the output from the shift position detector 24 has been inverted, it is judged that the shift operation had been canceled midway (YES to a step S209), and therefore the engine output reduction control is canceled. The engine output reduction control may be canceled when the shift position has been changed from the N position to the F position (or the R position).

Next, it is determined whether or not a predetermined time period (as designated by symbol "c" in FIG. 21) has elapsed from the start of the engine output reduction control (step S210), and when the predetermined time period has elapsed, the ignition timing is progressively restored from the retarded ignition timing to the normal ignition timing (step S211). The predetermined time period "c" is set depending on the hull (shape, weight, and loadage thereof) in which the outboard motor is installed and the load from the propeller. Also when the direction of the shift operation has been inverted, or when the warm-up condition has been changed, the ignition timing may be restored to the normal ignition timing.

Further, although in the detection of the shift operation, control is performed such that a subtle motion of the shift operation lever 21 (due to unconscious application of load on the shift operation lever 21 or variation in the output from the shift position detector 24) is prevented from being erroneously detected as the shift operation, the detection of the amount of change in the output from the shift operation detector 24 may be continued even after the shift operation is detected, and when a change in the output from the shift operation detector 24 in the opposite direction is detected as shown in FIG. 17 or no change in the output is detected (e g. the shift operation lever 21 is stopped and fixed midway during the shift operation), the engine output reduction control may be immediately canceled.

Although in the engine output reduction control described above, the case of shifting the shift position from the N position to the F position is given, the engine output reduction control may be carried out in respective different manners according to the shift operation from the N position to the F position and that from the N position to the R position, by setting controlled variables of the engine output reduction control, including the ignition timing retardation amount and the intake air amount, the slope of reduction in the engine speed, the lower limit value of the slope of reduction in the engine speed, and so forth, for each of the different operating directions of the shift operation.

Next, a description will be given of a process carried out when the shift operation lever 21 is switched from the F position to the N position while the boat is running at some speed.

Figure 23:
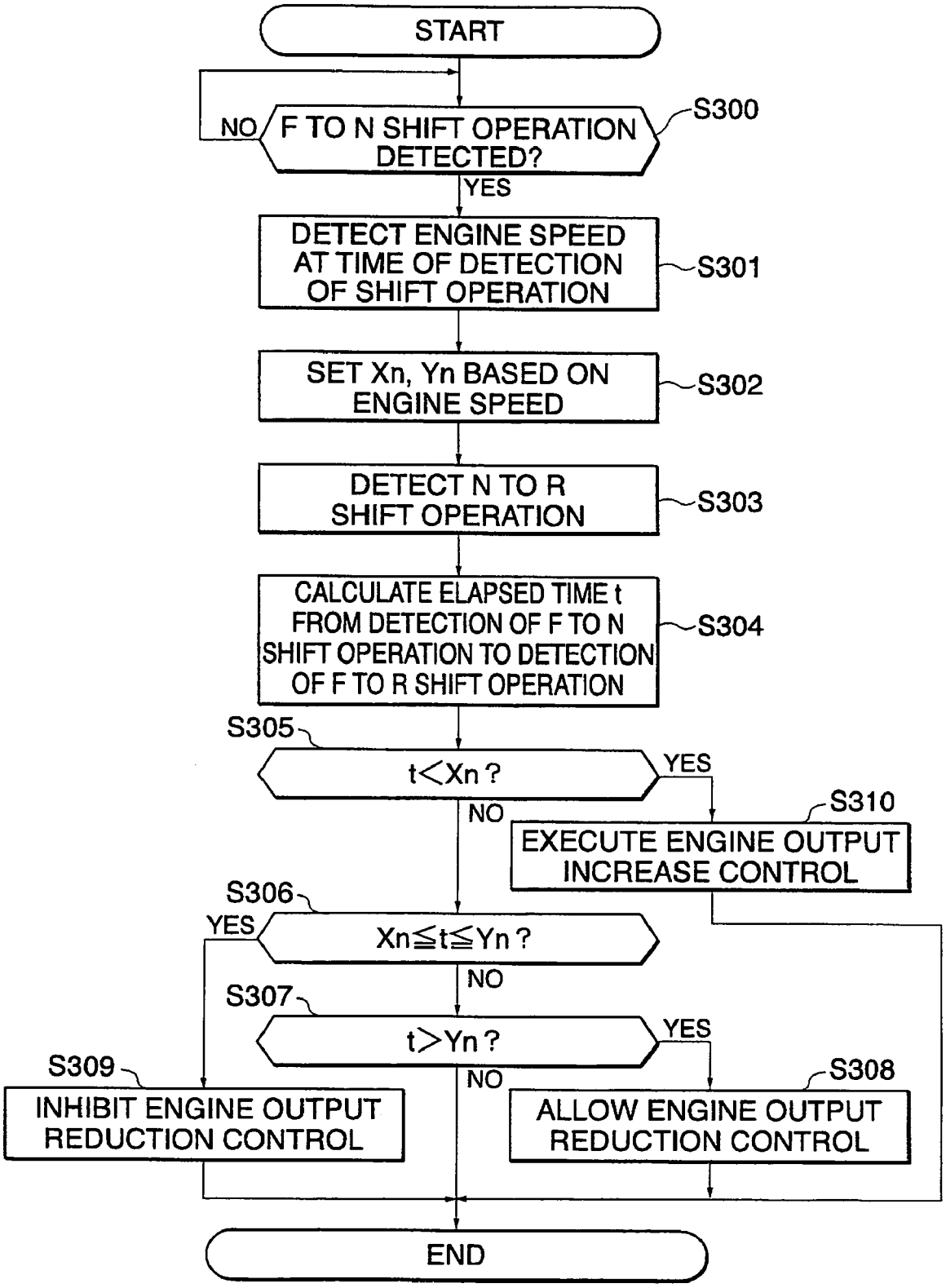
FIG. 23 is a diagram showing the procedure of a process in which the shift lever is switched from a position F to a position N when the boat is traveling at some speed.

FIG. 23 is a diagram showing the process carried out when the shift lever 21 is switched from the F position to the N position when the boat is traveling at some speed.

As shown in FIG. 23, first, it is determined whether or not the shift operation from the F position to the N position has been carried out (step S300), and then, the direction (forward or reverse) and speed of running of the boat are determined based on the engine speed detected when the shift operation from the F position to the N position was detected and the duration over which the shift operation lever has been held in the N position after being shifted to the N position (steps S301 to S304).

For example, there is a case where even when a sequence of operations, i.e. full throttle operation→rapid deceleration→shift operation from the F position to the N position→maintaining the idling engine speed are carried out, or even when the idling condition is further continued for 10 seconds from the above state, the boat still runs at some speed. Therefore, if it is configured such that the engine output reduction control is carried out only when the idling state has been continued, when the shift operation is repeatedly carried out during stoppage or very low running speed of the engine (F→N→R→N→F→N→R), the engine output reduction control does not work, and a shock occurs during the shift operation.

To overcome the problem, the engine speed at the time of detection of the shift operation is detected (step S301), and from the detected engine speed, a time period Xn over which the engine output reduction control is inhibited when the shift operation from the N position to the R position is carried out, and a time period Yn before transition to engine output increase control is determined when the shift operation from the N position to the R position is carried out are set based on Table 4 (step S302). In Table 4, there are set time periods X1 to Xn and Y1 to Yn.

TABLE 4

| | Engine Speed Region (rpm) | | | | |
|---|---|---|---|---|---|
| | N1–N2 | N2–N3 | N3–N4 | . . . | Nn- |
| Set Time Period | X1 | X2 | X3 | . . . | Xn |
| Set Time Period | Y1 | Y2 | Y3 | . . . | Yn |

Next, after the shift operation from the N position to the R position is detected (step S303), a calculation is made of elapsed time t from the detection of the shift operation from the F position to the N position and before the detection of the shift operation from the N position to the R position.

When a comparison of the calculated elapsed time t with the time period Xn (n: 1, 2, . . . , n) set in the step S302 (step S305) shows t<Xn (YES to the step S305), it is judged that the running speed of the boat in the forward direction is high, and therefore the engine output increase control is carried out when the shift operation from the N position to the R position is being carried out (step S310).

On the other hand, if Xn≦t≦Yn holds (YES to the step S306), it is judged that the boat is running at some speed in the forward direction, and when the shift operation from the N position to the R position is being carried out, the engine output reduction control is inhibited (step S309). Further, when t>Yn holds (YES to the step S307), the engine output reduction control is allowed (step S308). This makes it possible to reduce a shift shock even when the shift operation from the N position to the R position is carried out in a state where the boat is still running at some speed after execution of the shift operation from the F position to the N position.

For example, when the hull is running at full throttle and an engine speed of 6000 rpm, if the shift operation from the F position to the N position is carried out, it can be easily determined that the running speed will be high immediately after execution of the shift operation. Therefore, when the engine speed Na is set to a range of 5000 to 6000 rpm, the time period Xa to 10 seconds, and the time period Ya to 20 seconds, if the shift operation from the N position to the R position is carried out after the lapse of 5 seconds after execution of the shift operation from the N position to the R position, the engine output increase control is carried out.

On the other hand, if the shift operation from the N position to the R position is carried out after the lapse of 15 seconds, the engine output reduction control is inhibited. Further, if the shift operation from the N position to the R position is carried out after the lapse of 25 seconds, the engine output reduction control is allowed and executed.

As described above, according to the present embodiment, the shift position detector 24 continuously detects the shift operation by the shift operation lever 21, and when the shift operation detector 24 detects an early stage of the shift operation from the neutral position to the forward position or from the neutral position to the reverse position, control is performed to change the engine output, and after the lapse of a predetermined time period, the control for changing the engine output is canceled. Thus, the early stage of the shift operation, i.e. a state just before the operator increases the shift operating force applied to the shift operation lever 21 is detected, and the engine output is reduced, whereby a shock occurring during the shift operation can be reduced to facilitate the shift operation.

Further, when the shift position detected by the shift operation detector 24 is in the vicinity of the neutral position, and at the same time the detected amount of change the output from the shift operation detector 24 is not smaller than the predetermined value A, and exceeds the predetermined value "b" set for the neutral position, it is determined that the shift operation is in its early stage. As a result, it is possible to promptly and accurately determine whether a shift operation is being carried out by preventing erroneous detection or delayed detection of the shift operation due to assemblage errors in the shift operation detecting device 24 or variations in the output from the shift operation detecting device 24.

Further, when the shift position detector 24 detects a change in the output value indicative of the neutral position, the output value indicative of the neutral position after the change is learned. Therefore, even if the output value indicative of the neutral position is changed due to aging or the like, it is possible to promptly and accurately detect the shift operation since the learned neutral (N) value is set by the learning function.

Further, from the amount of change in the shift position detected by the shift position detector 24, the shift operation speed is determined, and when the shift operation speed is not larger than the predetermined value (predetermined output change amount) A, the engine output is changed. This makes it possible to prevent a stumble or unstable engine rotation by limiting the engine output change control at rapid acceleration.

Moreover, the running speed of the boat is determined from the engine speed during the shift operation from the forward position to the neutral position and the duration over which the neutral position has been maintained, and if the running speed of the boat is not higher than the predetermined value, the engine output is changed. This makes it possible to reduce a shock occurring during the shift operation and facilitate the shift operation.

Also, the engine output is changed through misfiring or ignition timing retardation, and through increase of the intake air amount. Therefore, it is possible to promptly reduce the engine output while preventing engine stalling even under various conditions.

Further, when the predetermined conditions for canceling the engine output change control are satisfied before the lapse of the predetermined time period, the control for changing the engine output is immediately canceled. As a result, it is possible to promptly reduce the engine output while preventing engine stalling even under various conditions.

What is claimed is:

1. A shift operation control system for an outboard motor including an engine and a forward/reverse-switching mechanism, wherein the forward/reverse-switching mechanism includes a forward gear, a reverse gear, a dog clutch, and a shift operation lever, wherein an output from the engine is selectively transmitted to one of the forward gear and the reverse gear to drive the one of the forward gear and the reverse gear, and wherein the dog clutch is actuated by a shift operation using the shift operation lever to switch a shift position between a forward position in which the dog clutch is meshed with the forward gear, a reverse position in which the dog clutch is meshed with the reverse gear, and a neutral position in which the dog clutch is not meshed with either the forward gear or the reverse gear, said shift operation system comprising:

a shift operation-detecting device which continuously detects the shift operation by the shift operation lever, and which determines that the shift operation is in an early stage from the forward position to the neutral position or from the reverse position to the neutral position when the shift operation-detecting device detects that a shift position of the shift operation lever is in a vicinity of the forward position or the reverse position and that an amount of change calculated between the shift position detected at a present timing and a shift position detected at an earlier timing is not smaller than a predetermined change amount value;

an engine output changing control device which changes the output from the engine; and a control device, which is operable to carry out control for changing the output from the engine using said engine output changing control device when: (i) the early stage of the shift operation from the forward position to the neutral position or from the reverse position to the neutral position is detected by said shift operation-detecting device, and (ii) a speed of the engine upon the detection of the early stage is not lower than a predetermined engine speed value, and to then cancel the control for changing the output from the engine when switching of the shift position to the neutral position is detected by said shift operation-detecting device.

2. A shift operation control system as claimed in claim 1, wherein said control device carries out the control for changing the output from the engine when the early stage of the shift operation is detected by said shift operation-detecting device, and when a throttle opening of the engine is not larger than a predetermined opening value.

3. A shift operation control system as claimed in claim 1, wherein said control device carries out the control for changing the output from the engine when the early stage of the shift operation is detected by said shift operation-detecting device, and when intake negative pressure in the engine is not higher than a predetermined negative pressure value.

4. A shift operation control system as claimed in claim 1, wherein said engine output changing control device changes the output from the engine by carrying out ignition control based on one of a number of consecutive misfires and an ignition timing retardation value, and the one of the number of consecutive misfires and the ignition timing retardation value is set in advance on an engine speed region-by-engine speed region basis.

5. A shift operation control system as claimed in claim 1, wherein the forward/reverse-switching mechanism comprises a first-actuated driving part inside the outboard motor, and said shift operation-detecting device is disposed at the first-actuated driving part.

6. A shift operation control system as claimed in claim 1, wherein the outboard motor comprises a remote control box for remotely operating the forward/reverse-switching mechanism inside the outboard motor, and the shift operation lever has a drive part disposed in the remote control box, and wherein said shift operation-detecting device is disposed in the drive part of the shift operation lever.

7. A shift operation control system for an outboard motor including an engine and a forward/reverse-switching mechanism, wherein the forward/reverse-switching mechanism includes a forward gear, a reverse gear, a dog clutch, and a shift operation lever, wherein an output from the engine is selectively transmitted to one of the forward gear and the reverse gear to drive the one of the forward gear and the reverse gear, and wherein the dog clutch is actuated by a shift operation using the shift operation lever to switch a shift position between a forward position in which the dog clutch is meshed with the forward gear, a reverse position in which the dog clutch is meshed with the reverse gear, and a neutral position in which the dog clutch is not meshed with either the forward gear or the reverse gear, said shift operation system comprising:

a shift operation-detecting device that continuously detects the shift operation by the shift operation lever;

an engine output changing control device that changes the output from the engine; and a control device, which is operable to carry out control for changing the output from the engine using said engine output changing control device when: (i) an early stage of the shift operation from the forward position to the neutral position or from the reverse position to the neutral position is detected by said shift operation-detecting device, and (ii) a speed of the engine upon the detection of the early stage is not lower than a predetermined engine speed value, and to then cancel the control for changing the output from the engine when switching of the shift position to the neutral position is detected by said shift operation detecting device;

wherein said engine output changing control device changes the output from the engine by carrying out ignition control based on one of a number of consecutive misfires and an ignition timing retardation value, and the one of the number of consecutive misfires and the ignition timing retardation value is set in advance on an engine speed region-by-engine speed region basis; and wherein said engine output changing control device sets an allowable slope of reduction in the speed of the engine per each predetermined number of times of ignition, and changes the one of the number of consecutive misfires and the ignition timing retardation value when a slope of reduction in the speed of the engine exceeds the allowable slope set in advance.

8. A shift operation control system for an outboard motor including an engine and a forward/reverse-switching mechanism, wherein the forward/reverse-switching mechanism includes a forward gear, a reverse gear, a dog clutch, and a shift operation lever, wherein an output from the engine is selectively transmitted to one of the forward gear and the reverse gear to drive the one of the forward gear and the reverse gear, and wherein the dog clutch is actuated by a shift operation using the shift operation lever to switch a shift position between a forward position in which the dog clutch is meshed with the forward gear, a reverse position in which the dog clutch is meshed with the reverse gear, and a neutral position in which the dog clutch is not meshed with either the forward gear or the reverse gear, said shift operation system comprising:

a shift operation-detecting device that continuously detects the shift operation by the shift operation lever;

an engine output changing control device that changes the output from the engine; and a control device, which is operable to carry out control for changing the output from the engine using said engine output changing control device when: (i) an early stage of the shift operation from the forward position to the neutral position or from the reverse position to the neutral position is detected by said shift operation-detecting device, and (ii) a speed of the engine upon the detection of the early stage is not lower than a predetermined engine speed value, and to then cancel the control for changing the output from the engine when switching of the shift position to the neutral position is detected by said shift operation detecting device;

wherein said engine output changing control device sets a lower limit of an allowable slope of reduction in the speed of the engine per each predetermined number of times of ignition, and cancels the control for changing the output from the engine when the slope of the reduction in the speed of the engine exceeds the lower limit of the allowable slope of reduction in the speed of the engine.

9. A shift operation control system for an outboard motor including an engine and a forward/reverse-switching mechanism, wherein the forward/reverse-switching mechanism includes a forward gear, a reverse gear, a dog clutch, and a shift operation lever, wherein an output from the engine is selectively transmitted to one of the forward gear and the reverse gear to drive the one of the forward gear and the reverse gear, and wherein the dog clutch is actuated by a shift operation using the shift operation lever to switch a shift position between a forward position in which the dog clutch is meshed with the forward gear, a reverse position in which the dog clutch is meshed with the reverse gear, and a neutral position in which the dog clutch is not meshed with either the forward gear or the reverse gear, said shift operation system comprising:

a shift operation-detecting device which continuously detects the shift operation by the shift operation lever, and which determines that the shift operation is in an early stage from the neutral position to the forward position or from the neutral position to the reverse position when the shift operation-detecting device detects that a shift position of the shift operation lever is in a vicinity of the neutral position and that an amount of change calculated between the shift position detected at a present timing and a shift position detected at an earlier timing is not smaller than a predetermined change amount value set for the neutral position;

an engine output changing control device that changes the output from the engine; and a control device, which is operable to carry out control for changing the output from the engine using said engine output changing control device when early stage of the shift operation from the neutral position to the forward position or from the neutral position to the reverse position is detected by said shift operation-detecting device, and to then cancel the control for changing the output from the engine after a predetermined time period elapses after completion of the control for changing the output from the engine.

10. A shift operation control system as claimed in claim 9, wherein said shift operation-detecting device includes a learning device that detects a change in an output value from said shift operation-detecting device produced when the shift position is in the neutral position, and said learning device is operable when the output value is changed to learn the changed output value.

11. A shift operation control system as claimed in claim 9, wherein said control device includes a determining device that determines a speed of a boat in which the outboard motor is installed, based on the speed of the engine detected when the shift operation from the forward position to the neutral position is detected, and a duration over which the neutral position has been maintained, and said control device carries out the control for changing the output from the engine when it is determined by said determining device that the speed of the boat is not higher than a predetermined value.

12. A shift operation control system as claimed in claim 9, wherein said engine output changing control device includes an intake air amount control device that controls an amount of intake air supplied to the engine, and said engine output changing control device changes the output from the engine by one of misfiring control and ignition timing control, while causing said intake air amount control device to increase the amount of intake air.

13. A shift operation control system as claimed in claim 9, wherein said control device immediately cancels the control for changing the output from the engine when predetermined conditions for canceling the control for changing the output from the engine are satisfied before the predetermined time period elapses.

14. A shift operation control system as claimed in claim 9, wherein the forward/reverse-switching mechanism comprises a first-actuated driving part inside the outboard motor, and said shift operation-detecting device is disposed at the first-actuated driving part.

15. A shift operation control system as claimed in claim 9, wherein the outboard motor comprises a remote control box for remotely operating the forward/reverse-switching mechanism inside the outboard motor, and the shift operation lever has a drive part disposed in the remote control box, and wherein said shift operation-detecting device is disposed in the drive part of the shift operation lever.

16. A shift operation control system for an outboard motor including an engine and a forward/reverse-switching mechanism, wherein the forward/reverse-switching mechanism includes a forward gear, a reverse gear, a dog clutch, and a shift operation lever, wherein an output from the engine is selectively transmitted to one of the forward gear and the reverse gear to drive the one of the forward gear and the reverse gear, and wherein the dog clutch is actuated by a shift operation using the shift operation lever to switch a shift position between a forward position in which the dog clutch is meshed with the forward gear, a reverse position in which the dog clutch is meshed with the reverse gear, and a neutral position in which the dog clutch is not meshed with either the forward gear or the reverse gear, said shift operation system comprising:

a shift operation-detecting device that continuously detects the shift operation by the shift operation lever;

an engine output changing control device that changes the output from the engine; and a control device, which is operable to carry out control for changing the output from the engine using said engine output changing control device, when an early stage of the shift operation from the neutral position to the forward position or from the neutral position to the reverse position is detected by said shift operation-detecting device, and to then cancel the control for changing the output from the engine after a predetermined time period elapses after completion of the control for changing the output from the engine; and wherein said shift operation-detecting device includes a determining device that determines a shift operation speed from an amount of change in the detected shift position, and said control device carries out the control for changing the output from the engine when it is determined by said determining device that the shift operation speed is not higher than a predetermined value.

* * * * *